US008768209B2

(12) United States Patent
Morita et al.

(10) Patent No.: US 8,768,209 B2
(45) Date of Patent: Jul. 1, 2014

(54) PROCESS CARTRIDGE, DEVELOPING DEVICE, AND IMAGE FORMING APPARATUS

(75) Inventors: Tomokazu Morita, Mishima (JP); Shinichi Nishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/450,276

(22) Filed: Apr. 18, 2012

(65) Prior Publication Data

US 2012/0269545 A1 Oct. 25, 2012

(30) Foreign Application Priority Data

Apr. 25, 2011 (JP) ..... 2011-097439

(51) Int. Cl.
*G03G 21/16* (2006.01)

(52) U.S. Cl.
USPC ..... 399/111; 399/284

(58) Field of Classification Search
USPC ..... 399/110, 111, 113, 115, 119, 274, 284
See application file for complete search history.

(56) References Cited

U.S. PATENT DOCUMENTS

2008/0131173 A1* 6/2008 Lee ..... 399/284
2008/0170880 A1* 7/2008 Hashimoto ..... 399/106
2010/0080615 A1* 4/2010 Kikuchi ..... 399/111

FOREIGN PATENT DOCUMENTS

JP 8-254895 A 10/1996

* cited by examiner

*Primary Examiner* — David Gray
*Assistant Examiner* — Thomas Giampaolo, II
(74) *Attorney, Agent, or Firm* — Canon USA Inc IP Division

(57) ABSTRACT

A developing device for use in image forming apparatus includes a developer bearing member configured to carry a developer for developing an electrostatic latent image to be formed on an image bearing member, a frame member configured to support the developer bearing member, a charging member configured to charge the image bearing member, a developer regulating member configured to regulate an amount of the developer to be carried by the developer bearing member, and a moving member configured to be rotatably disposed on the frame member and to support the developer regulating member, the moving member pressing the developer regulating member against the developer bearing member by a force received by contact of the charging member with the image bearing member.

18 Claims, 20 Drawing Sheets

PROCESS CARTRIDGE, DEVELOPING DEVICE, AND IMAGE FORMING APPARATUS

BACKGROUND OF THE INVENTION

1. Field of the Invention

The present disclosure relates to an image forming apparatus, and to a process cartridge and a developing device used in the image forming apparatus.

The image forming apparatus forms an image on a recording medium using, for example, an electrophotographic method. The process cartridge includes a cartridge provided by the integration of an image bearing member and a process unit acting upon the image bearing member, and is detachably attachable to an apparatus main body of the image forming apparatus. The developing device supplies a developer to a latent image formed on the image bearing member in the apparatus main body to form a visible image.

2. Description of the Related Art

In an image forming apparatus such as a laser beam printer and a copying machine, a contact developing method has been widely used for development of an image by causing a developer bearing member to contact a photosensitive member serving as an image bearing member. In such a contact developing method, there are cases where a developing roller having an elastic layer is used as a developer bearing member. Conventionally, a plate-like developing blade serving as a developer regulating member is caused to contact a developing roller so that the amount of toner carried by the developing roller is regulated. A thin toner layer is formed on the developing roller by the developing blade, and an electrostatic latent image formed on the photosensitive member contacts such a thin toner layer, so that a high quality toner image is formed.

Generally, the developing blade is fixed in a state of pressing the developing roller with a predetermined pressure. However, Japanese Patent Application Laid-Open No. 8-254895 discusses a developing device including a movable developing blade and a driving solenoid for moving the developing blade. For example, when a foreign substance is sandwiched between the developing blade and the developing roller, the developing blade is separated from the developing roller, so that the foreign substance can be removed.

Herein, if the developing blade constantly presses the developing roller for a long time, a blade mark may be generated on the developing roller. Such a blade mark can lead to deformation of the developing roller. Conventionally, such deformation is relatively small and not considered as a problem. However, a developing roller has been expected to reduce deformation thereof over the lapse of time to meet a recent demand for high quality images.

Although the separation of the developing blade from the developing roller as discussed in Japanese Patent Application Laid-Open No. 8-254895 can suppress deformation of the developing roller over the time, a drive unit needs to be disposed to move the developing blade. Such a configuration may increase complexity of the image forming apparatus.

SUMMARY OF THE INVENTION

The present disclosure is directed to a process cartridge having a simple configuration and capable of suppressing deformation of a developer bearing member caused by a developer regulating member.

According to an aspect of the present disclosure, a process cartridge detachably attachable to an apparatus main body of an image forming apparatus includes an image bearing member for bearing an electrostatic latent image, a first frame member configured to support the image bearing member, a developer bearing member configured to carry a developer for developing the electrostatic latent image, a second frame member configured to support the developer bearing member, a charging member configured to charge the image bearing member, a developer regulating member configured to regulate an amount of the developer to be carried by the developer bearing member, and a moving member configured to be rotatably disposed on the second frame member and to support the developer regulating member, the moving member pressing the developer regulating member against the developer bearing member by a force received by contact of the charging member with the image bearing member.

According to another aspect of the present disclosure, a process cartridge detachably attachable to an apparatus main body of an image forming apparatus includes an image bearing member for bearing an electrostatic latent image, a first frame member configured to support the image bearing member, a developer bearing member configured to carry a developer for developing the electrostatic latent image, a second frame member configured to support the developer bearing member and to be rotatably coupled with the first frame member, the second frame member being movable to a contact position to cause the developer bearing member to contact the image bearing member and a separation position to cause the developer bearing member to separate from the image bearing member, a developer regulating member configured to regulate an amount of the developer to be carried by the developer bearing member, a moving member configured to be rotatably disposed on the second frame member and to support the developer regulating member, and an urging unit configured to urge the moving member to press the developer regulating member against the developer bearing member, the urging unit being attached to the first frame member and the moving member and reducing a force for pressing the developer regulating member against the developer bearing member to be less than a force produced when the second frame member is in the contact position by a movement of the second frame member from the contact position to the separation position.

According to yet another aspect of the present disclosure, a developing device for use in an image forming apparatus includes a developer bearing member configured to carry a developer for developing an electrostatic latent image to be formed on an image bearing member, a frame member configured to support the developer bearing member, a charging member configured to charge the image bearing member, a developer regulating member configured to regulate an amount of the developer to be carried by the developer bearing member, and a moving member configured to be rotatably disposed on the frame member and to support the developer regulating member, the moving member pressing the developer regulating member against the developer bearing member by a force received by contact of the charging member with the image bearing member.

According to yet another aspect of the present disclosure, a developing device for use in an image forming apparatus including an image bearing member and a first frame member supporting the image bearing member includes a developer bearing member configured to carry a developer for developing an electrostatic image formed on the image bearing member, a second frame member configured to support the developer bearing member and to be movable, when the developing device is in use in the image forming apparatus, to a contact position to cause the developer bearing member to contact the image bearing member and a separation position to cause the developer bearing member to separate from the image bearing member, a developer regulating member configured to regulate an amount of the developer to be carried by the developer bearing member, and a moving member configured to be rotatably disposed on the second frame member and to support the developer regulating member, the moving member reducing a force for pressing the developer regulating member against the developer bearing member to be less than a force produced when the second frame member is in the contact position by a movement of the second frame member from the contact position to the separation position.

According to yet another aspect of the present disclosure, an image forming apparatus configured to form an image on a recording medium includes an image bearing member for bearing an electrostatic latent image, a developer bearing member configured to carry a developer for developing the electrostatic latent image, a frame member configured to support the developer bearing member, a charging member configured to charge the image bearing member, a developer regulating member configured to regulate an amount of the developer to be carried by the developer bearing member, a moving member configured to be rotatably disposed on the frame member and to support the developer regulating member, the moving member pressing the developer regulating member against the developer bearing member by a force received by contact of the charging member with the image bearing member, and a fixing unit configured to fix a developer image on the recording medium.

According to yet another aspect of the present disclosure, an image forming apparatus configured to form an image on a recording medium includes an image bearing member for bearing an electrostatic latent image, a first frame member configured to support the image bearing member, a developer bearing member configured to carry a developer for developing the electrostatic latent image, a second frame member configured to support the developer bearing member and to be rotatably coupled with the first frame member, the second frame member being movable to a contact position to cause the developer bearing member to contact the image bearing member and a separation position to cause the developer bearing member to separate from the image bearing member, a developer regulating member configured to regulate an amount of the developer to be carried by the developer bearing member, a moving member configured to be rotatably disposed on the second frame member and to support the developer regulating member, an urging unit configured to urge the moving member to press the developer regulating member against the developer bearing member, the urging unit being attached to the first frame member and the moving member and reducing a force for pressing the developer regulating member against the developer bearing member to be less than a force produced when the second frame member is in the contact position by a movement of the second frame member from the contact position to the separation position, and a contact-separation unit configured to cause the second frame member to move to the contact position and the separation position.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed therein.

DESCRIPTION OF THE EMBODIMENTS

Figure 1:
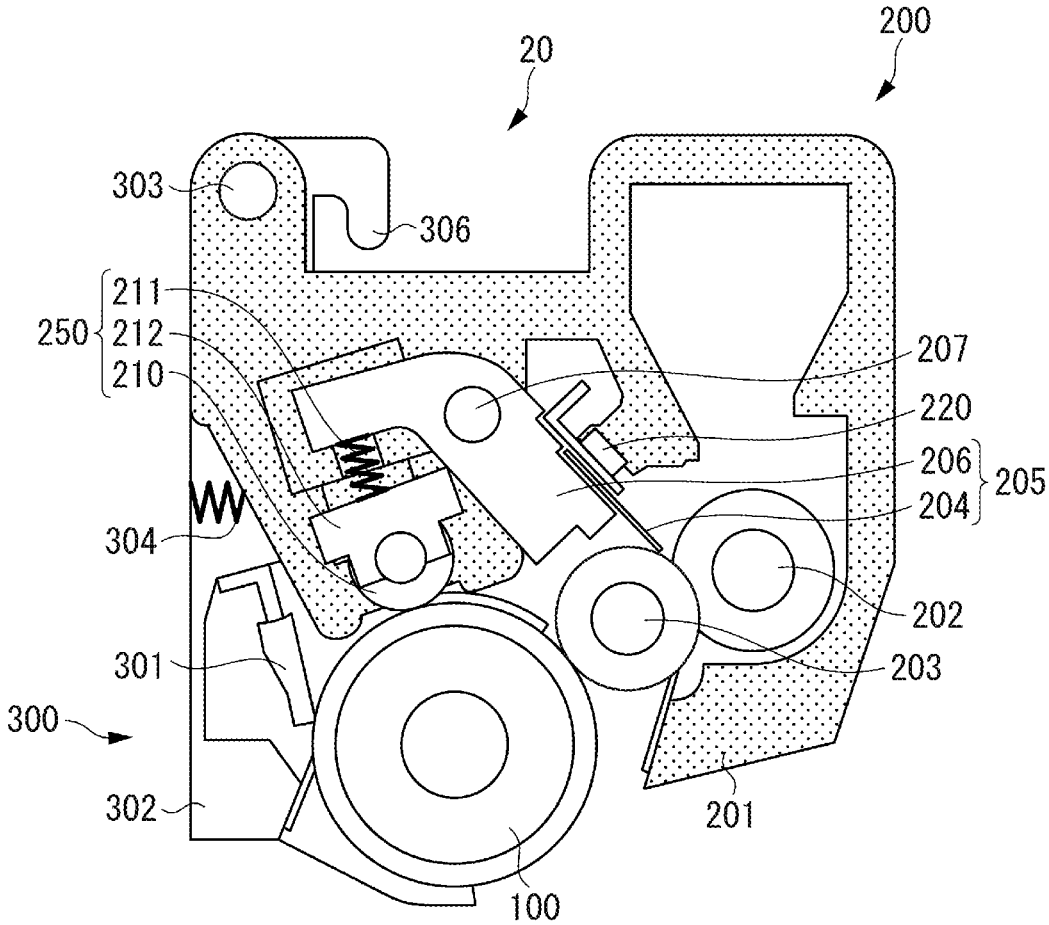
FIG. 1 is a schematic cross sectional view illustrating a process cartridge according to a first exemplary embodiment.

Various exemplary embodiments, features, and aspects of the disclosure will be described in detail below with reference to the drawings.

An image forming apparatus A1 according to a first exemplary embodiment is described with reference to a schematic cross sectional view illustrated in FIG. 9. The image forming apparatus A1 includes a process cartridge which is detachably mounted. For example, the image forming apparatus A1 of the present exemplary embodiment is a full color laser printer employing an in-line method and an intermediate transfer method. The image forming apparatus A1 can form a full color image on a recording sheet 800 serving as a recording medium based on image information. The image information is input to an image forming apparatus main body from an image reading apparatus (not shown) connected to the image forming apparatus main body or a host device such as a personal computer connected for communication to the image forming apparatus main body.

The image forming apparatus A1 includes first, second, third, and fourth image forming units SY, SM, SC, and SK for forming images in yellow (Y), magenta (M), cyan (C), and black (K), respectively. According to the present exemplary embodiment, the first through fourth image forming units SY, SM, SC, and SK are disposed side by side in the horizontal direction.

In the present exemplary embodiment, since the first through fourth image forming units are configured and operate substantially similar to one another except for the color of the image to be formed, the color abbreviations Y, M, C, and K are omitted in the general description below unless otherwise indicated.

The image forming apparatus A1 according to the present exemplary embodiment includes four drum-shaped electrophotographic photosensitive members as a plurality of image bearing members. More specifically, four photosensitive drums 100 are arranged in the horizontal direction. The photosensitive drum 100 is rotationally driven in a direction (clockwise) indicated by an arrow A shown in FIG. 9 by a drive unit (a drive source) which is not shown. A charging roller 210 serving as a charging member is disposed in the vicinity of the photosensitive drum 100. The charging roller 210 uniformly charges a surface of the photosensitive drum 100. A scanner unit 700 is disposed to irradiate the photosensitive drum 100 with a laser beam based on image information, thereby forming an electrostatic latent image on the photosensitive drum 100. A developing unit 200 is also disposed in the vicinity of the photosensitive drum 100. The developing unit 200 develops an electrostatic latent image as a toner image. Moreover, a cleaning blade 301 is disposed in the vicinity of the photosensitive drum 100. The cleaning blade 301 removes a residual toner (transfer residual toner) from the surface of the photosensitive drum 100 after a transfer process. An intermediate transfer belt 402 serving as an intermediate transfer member is disposed to face the four photosensitive drums 100. The intermediate transfer belt 402 transfers toner images on the photosensitive drums 100 to the recording sheet 800. In a rotation direction of the photosensitive drum 100, charging, exposing, developing, transferring, and cleaning processes are performed in sequence.

In the present exemplary embodiment, the developing unit 200 uses a non-magnetic one-component developer as a developer. That is, a toner is used. In the present exemplary embodiment, the developing unit 200 performs reversal development by causing a developing roller 203 serving as a developer bearing member to contact the photosensitive drum 100. More specifically, the developing unit 200 develops an electrostatic image by causing a toner charged with the polarity similar to the charge polarity of the photosensitive drum 100 (a negative polarity in the present exemplary embodiment) to adhere to an attenuated portion (an image portion, an exposure portion) on the photosensitive drum 100. The attenuated portion has the electric charge, which has been attenuated by exposure to light.

The intermediate transfer belt 402 is an endless belt. The intermediate transfer belt 402 contacts all of the photosensitive drums 100, and moves (rotates) in a circular manner in a direction (counterclockwise) indicated by an arrow B shown in FIG. 9. The intermediate transfer belt 402 is extended across and supported by a secondary transfer roller 401, a secondary transfer counter roller 404, a driven roller 405, and a driving roller 407.

Four primary transfer rollers 400 are aligned side by side on an inner circumferential side of the intermediate transfer belt 402 such that the primary transfer rollers 400 face the respective photosensitive drums 100. The primary transfer roller 400 presses the intermediate transfer belt 402 toward the photosensitive drum 100 to form a primary transfer portion in which the intermediate transfer belt 402 and the photosensitive drum 100 contact each other. The primary transfer roller 400 is applied with a bias having a polarity opposite to that of the normal charge of the toner from a primary transfer bias power source (high-voltage power source) which is not shown. Accordingly, a toner image on the photosensitive drum 100 is transferred (primary transfer) to the intermediate transfer belt 402.

On an outer circumferential side of the intermediate transfer belt 402, the secondary transfer roller 401 is disposed in a position facing the secondary transfer counter roller 404. The secondary transfer roller 401 presses the secondary transfer counter roller 404 through the intermediate transfer belt 402 to form a secondary transfer portion in which the intermediate transfer belt 402 and the secondary transfer roller 401 contact each other. The secondary transfer roller 401 is applied with a bias having a polarity opposite to that of the normal charge of the toner from a secondary transfer bias power source (high-voltage power source) which is not shown. Accordingly, a toner image on the intermediate transfer belt 402 is transferred (secondary transfer) to the recording sheet 800 fed from a sheet feeding unit. Herein, the primary transfer roller 400 and the secondary transfer roller 401 have similar configurations. An intermediate transfer belt cleaning member 406 collects a residual toner on the intermediate transfer belt 402.

The recording sheet 800 having a toner image transferred thereon is conveyed to a fixing device 500. The fixing device 500 applies heat and pressure to the recording sheet 800, so that the toner image (developer image) is fixed on the recording sheet 800.

The cleaning blade 301 removes and collects the primary transfer residual toner from the photosensitive drum 100 after the primary transfer process, whereas the intermediate transfer belt cleaning member 406 cleans the secondary transfer residual toner on the intermediate transfer belt 402 after the secondary transfer process.

The image forming apparatus A1 can use a single desired image forming unit or some (not all) desired image forming units to form a single color image or a multicolor image.

Moreover, the image forming apparatus A1 has a low speed mode as a thick paper mode. For example, when thick paper is used as the recording sheet 800, the image forming apparatus A1 forms an image at a speed that is ⅓ of that of the normal mode, so that fixability can be obtained.

The image forming apparatus A1 having such a configuration is used an example to describe the exemplary embodiment of the present invention. However, the present invention is not limited thereto.

Figure 9:
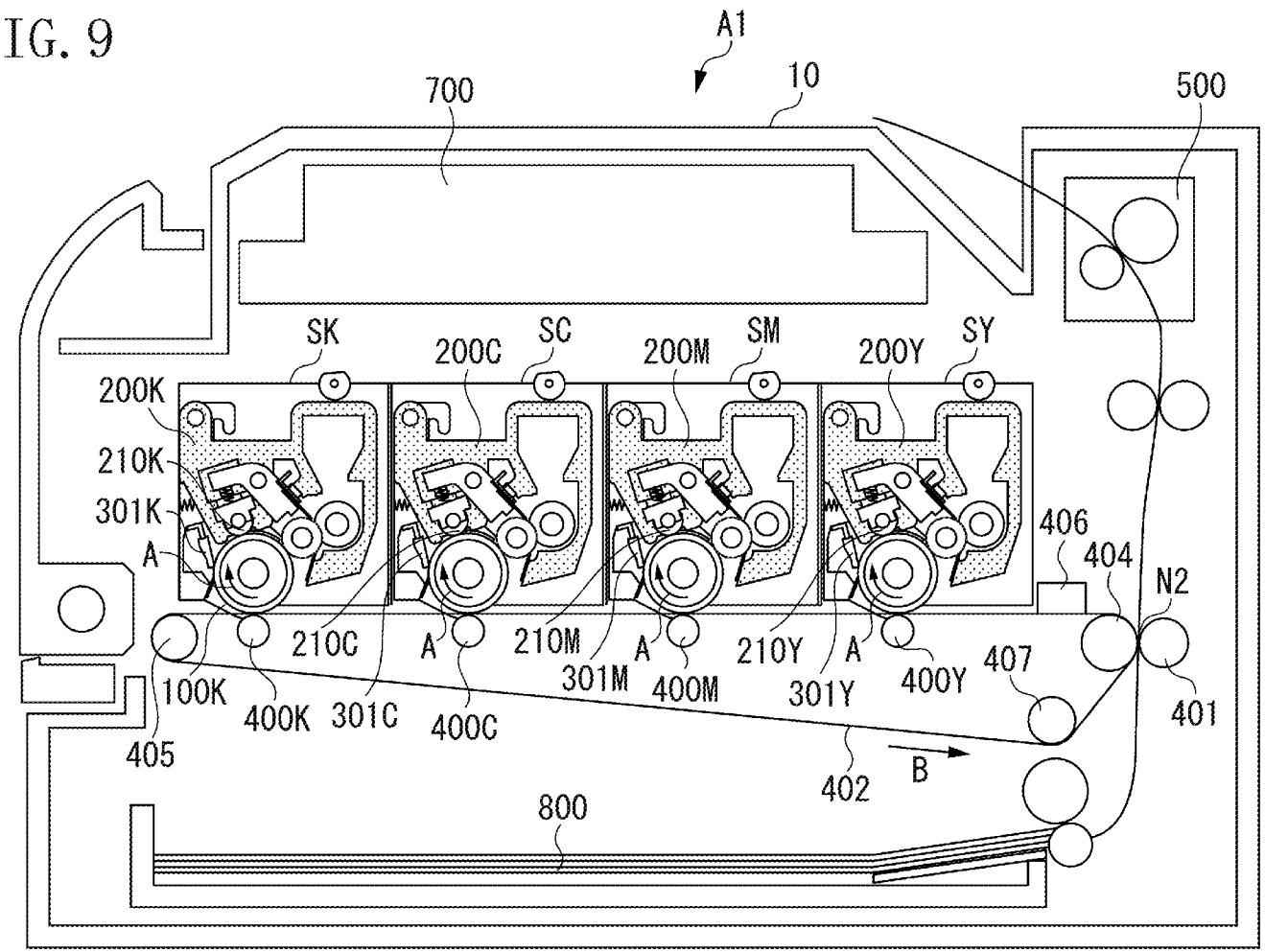
FIG. 9 is a schematic cross sectional view illustrating the image forming apparatus according to the first exemplary embodiment.

Each of the first through fourth image forming units SY, SM, SC, and SK of the image forming apparatus A1 illustrated in FIG. 9 includes a process cartridge 20 which is integration of a C unit 300 serving as a first unit and the developing unit 200 serving as a second unit. The process cartridge 20 is detachably attachable to an image forming apparatus main body (hereinafter referred to as an apparatus main body) 10. The apparatus main body 10 represents a portion of the image forming apparatus A1 without a portion of the process cartridge 20.

FIG. 1 is a schematic cross sectional view illustrating the process cartridge 20 attached to the apparatus main body 10. In the present exemplary embodiment, the process cartridges 20 have substantially the same shape, and yellow (Y), magenta (M), cyan (C), and black (K) toners are stored in the respective process cartridges 20. Now, a description is given of each of the units disposed inside the process cartridge 20.

The C unit 300 includes a C frame member (first frame member) 302 serving as a frame member for supporting various components provided inside the C unit 300. The C frame member 302 includes a bearing (not shown) for supporting a shaft of the photosensitive drum 100 to rotatably support the photosensitive drum 100. For example, the photosensitive drum 100 includes an aluminum cylinder having an outer diameter of 24 mm, and an organic photoconductor layer coated on the outer circumference of the cylinder.

The C frame member 302 includes the cleaning blade 301 such that the cleaning blade 301 contacts a circumferential surface of the photosensitive drum 100. The cleaning blade 301 is a cleaning member for removing a residual toner from the photosensitive drum 100 after a toner image formed on the photosensitive drum 100 is transferred to the intermediate transfer belt 402. For example, the cleaning blade 301 is made of urethane rubber.

The C frame member 302 includes a separation spring 304, which is a compression coil spring. The separation spring 304 functions to separate the developing roller 203 of the developing unit 200 from the photosensitive drum 100 by urging the developing unit 200.

The developing unit 200, on the other hand, includes a development frame member (second frame member) 201 serving as a frame member for supporting various components disposed inside the developing unit 200. In the development frame member 201, the developing roller 203 is rotatably supported. The developing roller 203 is a developer bearing member, and develops an electrostatic latent image formed on the photosensitive drum 100 by contacting the photosensitive drum 100. For example, the developing roller 203 includes an elastic roller having an outer diameter of 12 mm. The elastic roller has a core bar having an outer diameter of 6 mm, and silicone rubber serving as a conductive elastic layer having a thickness of 3 mm is provided on an outer circumference of the core bar. A surface of the elastic roller may have a coated layer having an electric charge imparting function to a developer.

Moreover, a charging roller bearing 212 is movably disposed on the development frame member 201. The charging roller bearing 212 supports the charging roller 210 in a rotatable manner. The charging roller 210 is a charging member for charging the photosensitive drum 100 by contacting the photosensitive drum 100. The charging roller 210 includes an elastic roller including a core bar and a conductive elastic layer overlaid on an outer circumference of the core bar. Specifically, the charging roller 210 includes the core bar and three layers, which are a bottom layer, a middle layer, and a surface layer overlaid on the core bar. The core bar has an outer diameter of 6 mm. For example, the bottom layer is made of ethylene propylene rubber (EPDM) having a layer thickness of 3 mm and a volume resistivity of $10^3$ Ωm, and is overlaid on the core bar. The middle layer is made of nitrile butadiene rubber (NBR) having a layer thickness of 700 μm and a volume resistivity of $10^3$ Ωm, and the surface layer is made of fluorine compound resin "TORESIN" (trademark) having a layer thickness of 10 μm and a volume resistivity of $10^8$ Ωm. The middle layer and the surface layer are overlaid on the bottom layer. In addition, carbon is dispersed in the bottom layer and the middle layer, and stannous oxide and carbon are dispersed in the surface layer.

In addition, a swing unit 205 is disposed on the development frame member 201. The swing unit 205 includes a swing frame member 206 and a developing blade 204.

The swing frame member 206 is rotatably supported by the swing fulcrum shaft 207 on the development frame member 201, and thus is a moving member capable of rotating about a swing fulcrum shaft 207.

The developing blade 204 is a developer regulating member. The developing blade 204 contacts the developing roller 203 to regulate an amount of the toner carried by the developing roller 203, thereby forming a thin toner layer on the developing roller 203. The developing blade 204 has one end portion which is supported by the swing frame member 206 and is in a lateral direction (a direction perpendicular to the longitudinal direction of the developing roller 203). The developing blade 204 includes a thin-plate elastic member to be in contact with the developing roller 203, and a supporting plate for supporting the thin-plate elastic member to be attached to the development frame member 201. For example, the supporting plate is a steel sheet "ZINKOTE" (trademark) having a thickness of 1.2 mm, whereas the thin-plate elastic member is made of stainless used steel (SUS) having a thickness of 120 μm.

In the development frame member 201, moreover, a pressure spring 211 is disposed. The pressure spring 211 is a compression coil spring, which presses the charging roller 210 against the photosensitive drum 100 through the charging roller bearing 212. The pressure spring 211 has one end being in contact with the charging roller bearing 212, and the other end being in contact with the swing frame member 206. The pressure spring 211 is a pressing member for pressing the charging roller 210 against the photosensitive drum 100 while pressing the developing blade 204 against the developing roller 203 through the swing frame member 206.

The development frame member 201 has a toner containing unit in which a supply roller 202 for supplying a toner to be carried by the developing roller 203 is disposed. For example, the supply roller 202 includes an elastic sponge roller having an outer diameter of 16 mm. The elastic sponge roller includes a core bar having an outer diameter of 6 mm and foaming structured polyurethane foam provided on the core bar, the polyurethane foam having low hardness and a thickness of 5 mm.

A sealing member 220 is disposed on the development frame member 201. The sealing member 220 contacts the developing blade 204 so that the toner inside the development frame member 201 is sealed to prevent leakage of the toner to the outside of the developing unit 200. For the sealing member 220, a foam body made of a formed EPDM mixture is used.

The developing unit 200 and the C unit 300 are fixed by providing a rotation shaft 303 through the development frame member 201 and the C frame member 302. The developing unit 200 is rotatably coupled with the C unit 300 around the rotation shaft 303. Accordingly, the development frame member 201 of the developing unit 200 can be located in a contact position and a separation position with respect to the C frame member 302 of the C unit 300. The developing roller 203 is caused to contact the photosensitive drum 100 in the contact position, whereas the developing roller 203 is caused to separate from the photosensitive drum 100 in the separation position.

Figure 11:
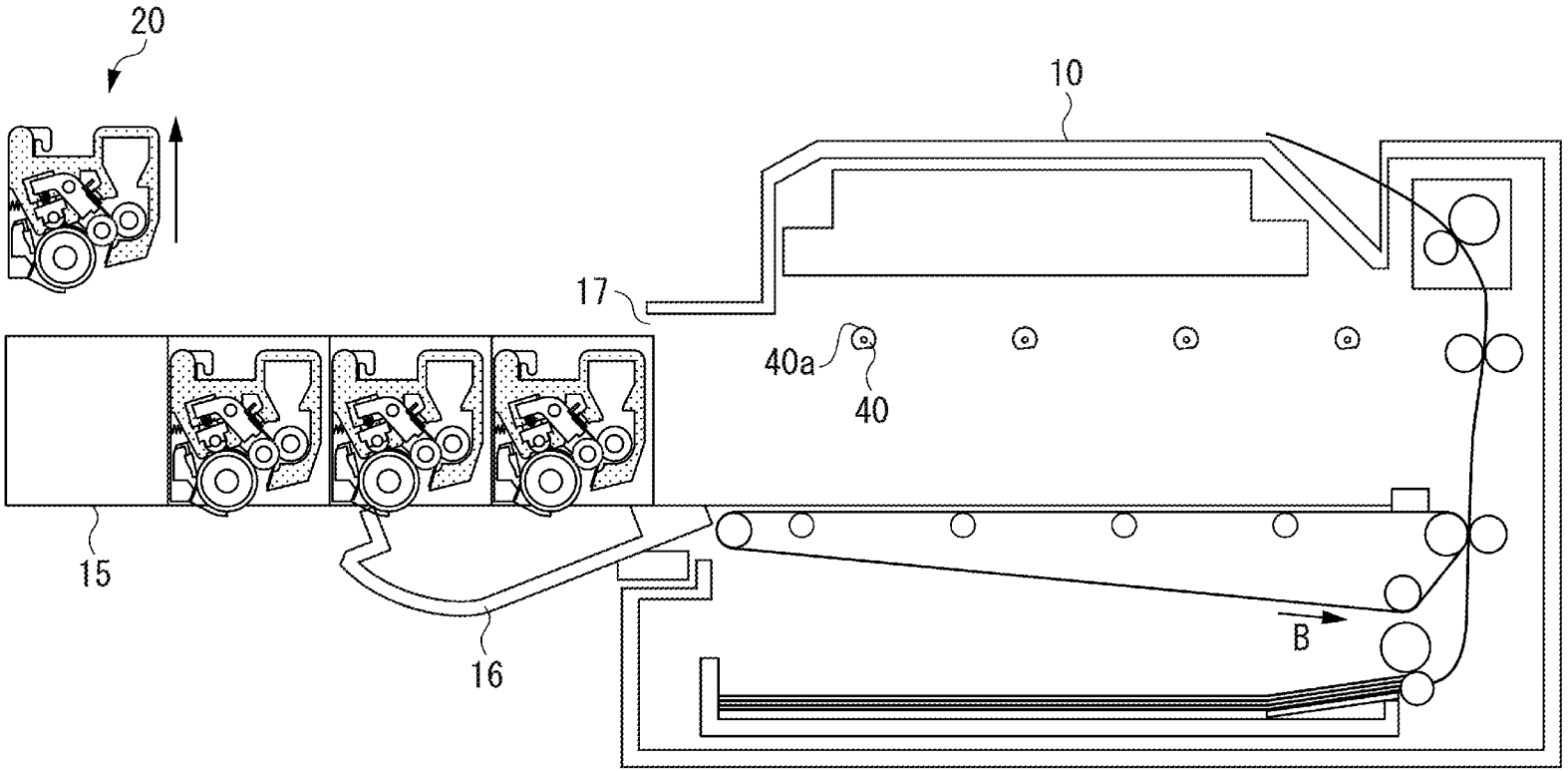
FIG. 11 is a schematic cross sectional view illustrating an operation of attaching the process cartridge to an apparatus main body.

FIG. 11 illustrates a method for attaching and detaching the process cartridge 20 with respect to the apparatus main body 10. FIG. 11 is a schematic cross sectional view of the apparatus main body 10 when a cartridge tray 15 is pulled out.

The apparatus main body 10 includes the cartridge tray 15 capable of being pulled out in a substantially horizontal direction from the inside of the apparatus main body 10. The cartridge tray 15 is an attachment unit for attaching the process cartridge 20 to the apparatus main body 10.

When the process cartridge 20 is attached to the apparatus main body 10, a door 16 of the apparatus main body 10 is opened, and the cartridge tray 15 is pulled out from an opening 17 provided in the apparatus main body 10. Then, the process cartridge 20 is attached to the cartridge tray 15 from above, and the cartridge tray 15 is pushed into the apparatus main body 10. Accordingly, the process cartridge 20 is attached to the inside of the apparatus main body 10 in a position where the process cartridge 20 can form an image.

Figure 2A:
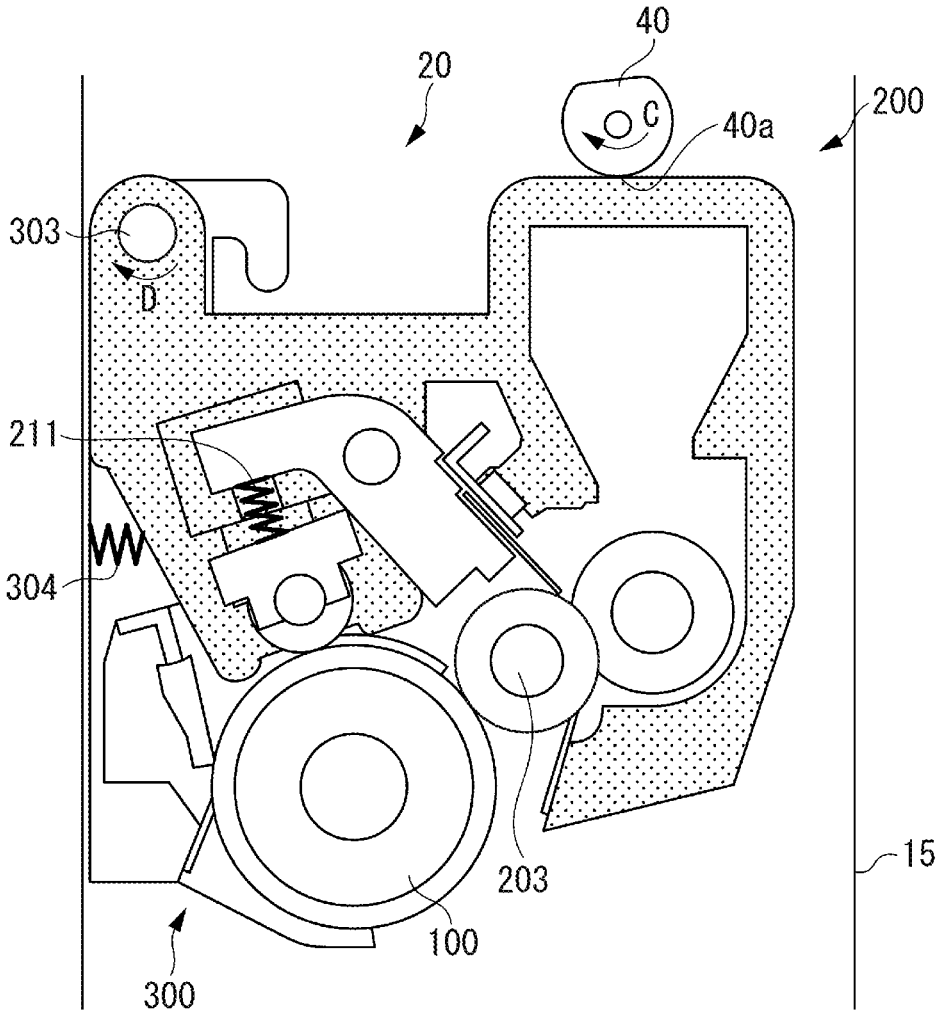
FIGS. 2A and 2B are schematic cross sectional views illustrating the process cartridge in contact and separation operations on a developing roller and a photosensitive drum.
Figure 2B:
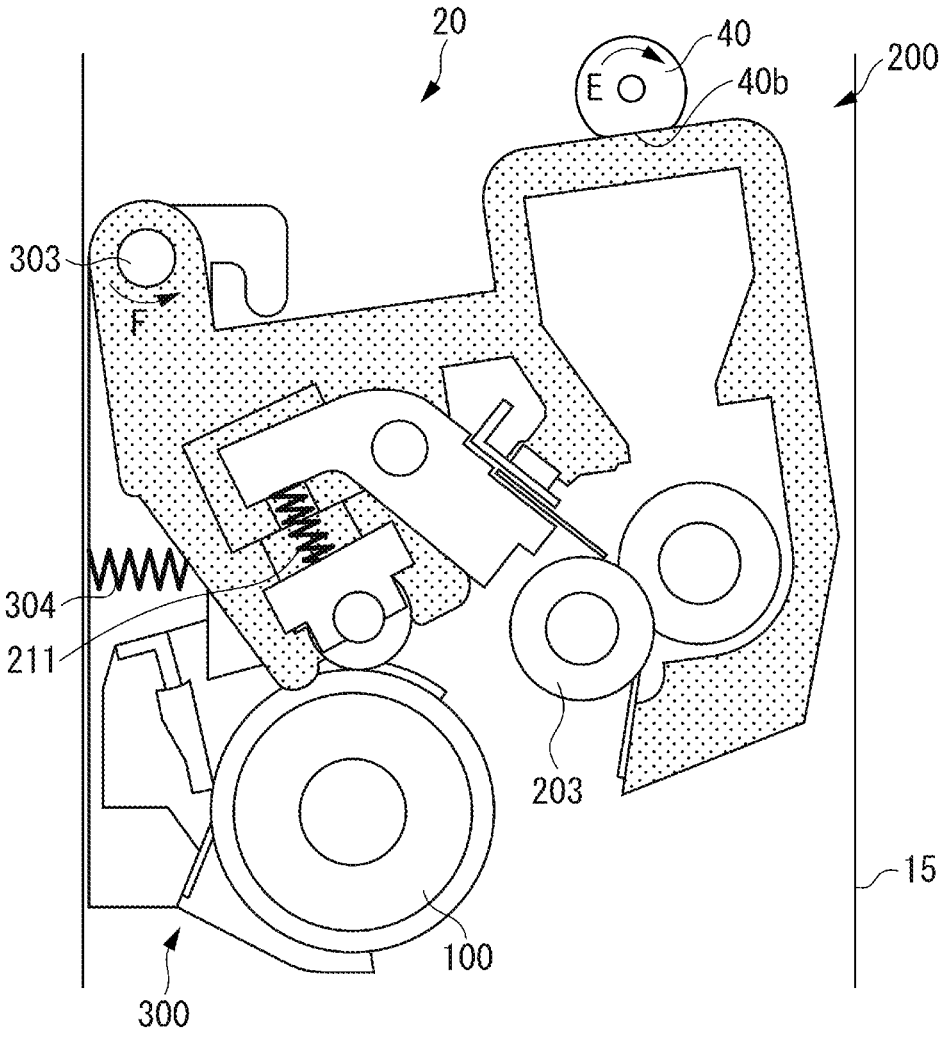

Referring to FIGS. 2A and 2B, a description is given of an operation of the developing unit 200 when the process cartridge 20 is attached to the apparatus main body 10. FIGS. 2A and 2B are schematic cross sectional views illustrating a movement operation of the developing unit 200 by a pressure cam 40 when the process cartridge 20 is attached to the apparatus main body 10.

When an external device (not shown) transmits image information for printing, a print job starts. FIG. 2A illustrates a state that the print job is being executed, whereas FIG. 2B illustrates a state that the print job is being stopped. As illustrated in FIGS. 2A and 2B, the pressure cam 40 is rotatably disposed with respect to the apparatus main body 10. The pressure cam 40 is a contact-separation unit for controlling the contact and separation of the developing roller 203 and the photosensitive drum 100 by moving the developing unit 200 inside the apparatus main body 10.

Figure 3:
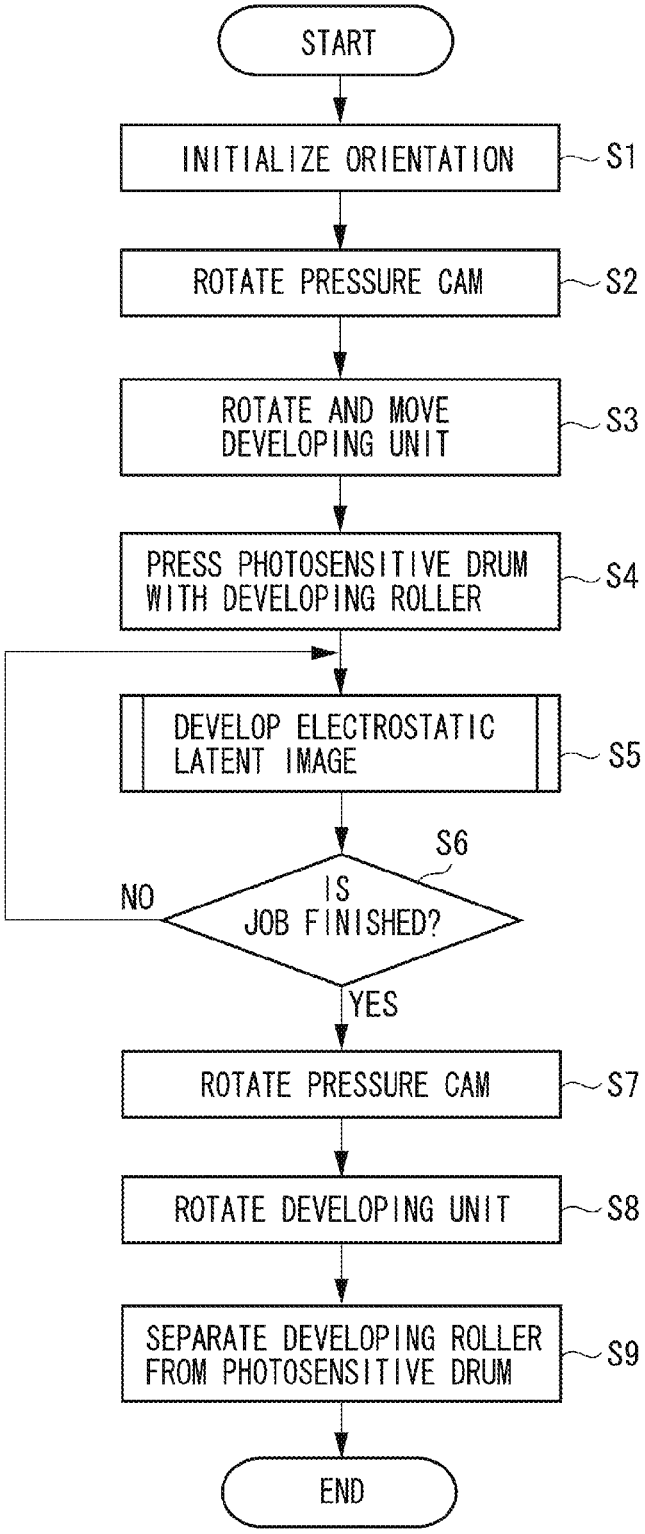
FIG. 3 is a flowchart illustrating an operation of an image forming apparatus.

The operation of the pressure cam 40 is described with reference to a sequence chart illustrated in FIG. 3. The pressure cam 40 operates to cause the developing roller 203 to contact the photosensitive drum 100, and operates to cause the developing roller 203 to separate from the photosensitive drum 100.

When an image forming unit inside the apparatus main body 10 receives a print job, a solenoid (not shown) is turned ON, thereby transmitting a driving force from a motor (not shown) to the pressure cam 40. In step S1, an orientation of the pressure cam 40 is initialized. A sensor (not shown) detects a position (orientation) of the pressure cam 40, so that a control unit (not shown) in the apparatus main body 10 grasps a rotation angle of the pressure cam 40, and rotates the pressure cam 40 to a home position in which a rotation angle is a predetermined angle. In such initialization, the sensor is used to detect the orientation of the pressure cam 40. However, the sensor may not be used as long as the orientation of the pressure cam 40 can be initialized.

In step S2, the pressure cam 40 rotates clockwise from the home position as illustrated in FIGS. 2A and 2B. When the pressure cam 40 rotates in a direction indicated by an arrow C shown in FIG. 2A from the home position, a raised portion 40*a* of the pressure cam 40 contacts the developing unit 20 to press the developing unit 200 as illustrated in FIG. 2B. In step S3, when pressed by the raised portion 40*a*, the developing unit 200 rotates in a direction indicated by an arrow D shown in FIG. 2A about the rotation shaft 303 as a fulcrum, so that the developing roller 203 is moved to contact the photosensitive drum 100 in a contact position. Then, in step S4, when the solenoid is turned OFF, the orientation of the pressure cam 40 is fixed, and the developing roller 203 continues to press the photosensitive drum 100. In step S5, an electrostatic latent image formed on the photosensitive drum 100 can be developed with a toner carried by the developing roller 203 in a state illustrated in FIG. 2A.

If the print job is finished (YES in step S6), then in step S7, the solenoid is turned ON again, and the pressure cam 40 starts to rotate in a direction indicated by an arrow E shown in FIG. 2B. Accordingly, the raised portion 40*a* of the pressure cam 40 separates from the developing unit 200, and the pressing force applied by the pressure cam 40 to the developing unit 200 is reduced. Herein, in step S8, the developing unit 200 rotates in a direction indicated by an arrow F shown in FIG. 2B about the rotation shaft 303 as a fulcrum by the force applied by the separation spring 304. In step S9, the developing unit 200 rotates until contacting a recessed portion 40*b* of the pressure cam 40, so that the developing roller 203 is moved to separate from the photosensitive drum 100 in a separation position as illustrated in FIG. 2B. When an image is not formed, the developing roller 203 separates from the photosensitive drum 100, thereby suppressing deformation of the developing roller 203 due to the pressure applied from the photosensitive drum 100. Herein, the separation spring 304 is a second urging unit for urging the developing unit 200 to cause the developing roller 203 to separate from the photosensitive drum 100.

When the cartridge tray 15 is pulled out from the apparatus main body 10 as illustrated in FIG. 11, the raised portion 40*a* of the pressure cam 40 is oriented upward. That is, the cartridge tray 15 needs to be moved without being interrupted by interference between the pressure cam 40 and the process cartridge 20.

Figure 4:
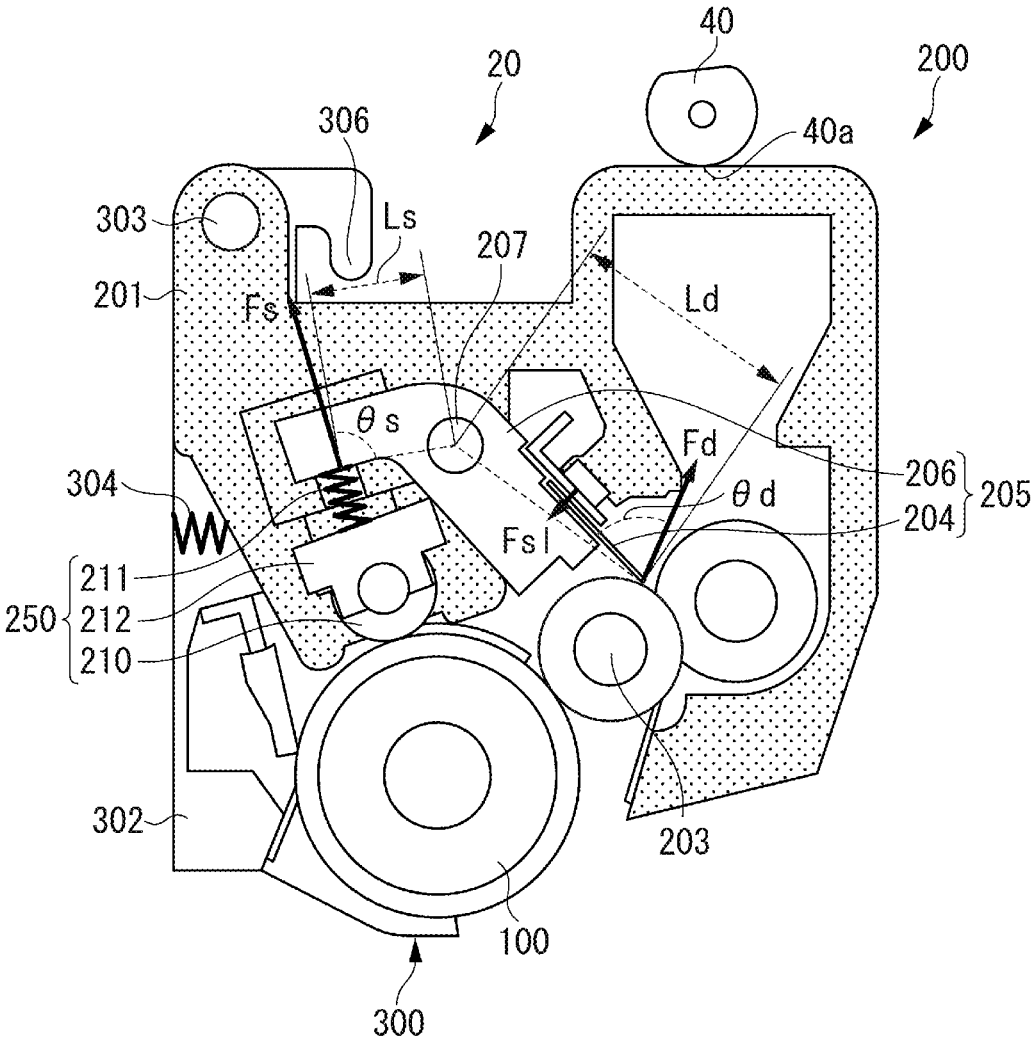
FIG. 4 is a schematic cross sectional view illustrating the process cartridge with a force to be applied to a swing unit when the developing roller and the photosensitive drum contact each other.

Referring to FIG. 4, a description is given of a force to be applied to the swing unit 205 when the developing unit 200 is in a contact position to cause the developing roller 203 to contact the photosensitive drum 100.

The swing unit 205 includes the swing frame member 206 and the developing blade 204. The swing frame member 206 is rotatably supported and disposed on the development frame member 201 by a swing fulcrum shaft 207. The developing blade 204 has one lateral end portion fixed to the swing frame member 206. The swing unit 205 is urged by a first urging unit 250 disposed in the developing unit 200 such that the developing blade 204 presses the developing roller 203. In the present exemplary embodiment, the first urging unit 250 includes the charging roller 210, the charging roller bearing 212, and the pressure spring 211. The first urging unit 250 is configured such that the charging roller 210 uses the force applied from the photosensitive drum 100 of the C unit 300 to urge the swing unit 205. A detailed description is given below.

In the developing unit 200, the charging roller 210 is supported by the charging roller bearing 212 movably disposed on the development frame member 201. Herein, when the developing unit 200 is in the contact position, the charging roller bearing 212 is provided such that a movement direction of the charging roller bearing 212 coincides with a straight line connecting the center of the photosensitive drum 100 with the center of the charging roller 210.

Moreover, one end portion of the pressure spring 211 is attached to the charging roller bearing 212, so that the charging roller 210 is pressed against the photosensitive drum 100. The other end portion of the pressure spring 211 is attached to the swing frame member 206. A position in which the charging roller bearing 212 is attached to the swing frame member 206 is on the opposite side to a position in which the developing blade 204 is attached to the swing frame member 206 based on the swing fulcrum shaft 207.

When the developing roller 203 contacts the photosensitive drum 100, the charging roller 210 contacts the photosensitive drum 100 and receives a pressing force from the photosensitive drum 100. Herein, since the charging roller bearing 212 is movably disposed, the charging roller 210 is pushed together with the charging roller bearing 212 into the development frame member 201. Accordingly, the pressure spring 211 attached to the charging roller bearing 212 is compressed.

Such compression reduces a length of the pressure spring 211, and applies a force to the swing frame member 206 since the pressure spring 211 is also in contact with the swing frame member 206. Such a force generates a clockwise moment about the swing fulcrum shaft 207 as a fulcrum in the swing unit 205 including the swing frame member 206 and the developing blade 204. The swing unit 205 is urged clockwise by the moment, thereby pressing the developing blade 204 against the developing roller 203. That is, the swing unit 205 is urged in a direction to press the developing blade 204 against the developing roller 203 by the first urging unit 250 including the charging roller 210, the charging roller bearing 212, and the pressure spring 211.

The swing unit 205 causes the developing blade 204 to contact the developing roller 203, so that a position thereof with respect to the swing frame member 206 is determined. In such a state, a moment to be added to the swing unit 205 is balanced. The balance of the moment is expressed as the following equation (1):

$$Fd \times Ld \times \sin \theta d = Fs \times Ls \times \sin \theta s \quad (1)$$

The abbreviations in equation (1) are as follows:

Fd: A force to be applied by the developing roller 203 to the developing blade 204.

Ld: A length from the center of the swing fulcrum shaft 207 to a contact point between the developing roller 203 and the developing blade 204.

θd: An angle formed by a straight line from the center of the swing fulcrum shaft 207 to a contact point between the developing roller 203 and the developing blade 204 and a straight line extending in a direction in which the force Fd is generated.

Fs: A force to be applied by the pressure spring 211 to the swing frame member 206.

Ls: A length from the center of the swing fulcrum shaft 207 to a contact point between the pressure spring 211 and the swing frame member 206.

θs: An angle formed by a straight line from the center of the swing fulcrum shaft 207 to a contact point between the pressure spring 211 and the swing frame member 206 and a straight line extending in a direction in which the force Fs is generated.

Herein, the force Fd is generated in a radial direction of the developing roller 203 from a contact point in which the developing blade 204 contacts the developing roller 203 as a starting point as illustrated in FIG. 4. That is, the force Fd is generated in a direction toward a contact point between the developing blade 204 and the developing roller 203 from the center of the developing roller 203. The force Fs is generated in a direction in which the pressure spring 211 extends from a contact point between the pressure spring 211 and the swing frame member 206 as a starting point. The pressure spring 211 is stretched and compressed in a direction in which the charging roller bearing 212 moves.

The left side of equation (1) represents a counterclockwise moment about the swing fulcrum shaft 207 illustrated in FIG. 4, whereas the right side of equation (1) represents a clockwise moment about the swing fulcrum shaft 207. Equation (1) holds when the developing blade 204 is in contact with the developing roller 203.

The force Fed to be added by the developing roller 203 to the developing blade 204 is determined by equation (1) based on the length Ld, angle θd, force Fs, length Ls, angle θs, and force Fs. That is, the force Fd can be suitably selected by, for example, changing an arrangement and a configuration of the pressure spring 211 and the swing frame member 206. Moreover, the developing blade 204 presses the developing roller 203 with a force that has an amount substantially the same as that of Fd. Therefore, an amount of force to be applied by the developing blade 204 to the developing roller 203 can become suitable for image forming by changing a configuration or arrangement of the pressure spring 211 or the swing frame member 206.

Figure 5:
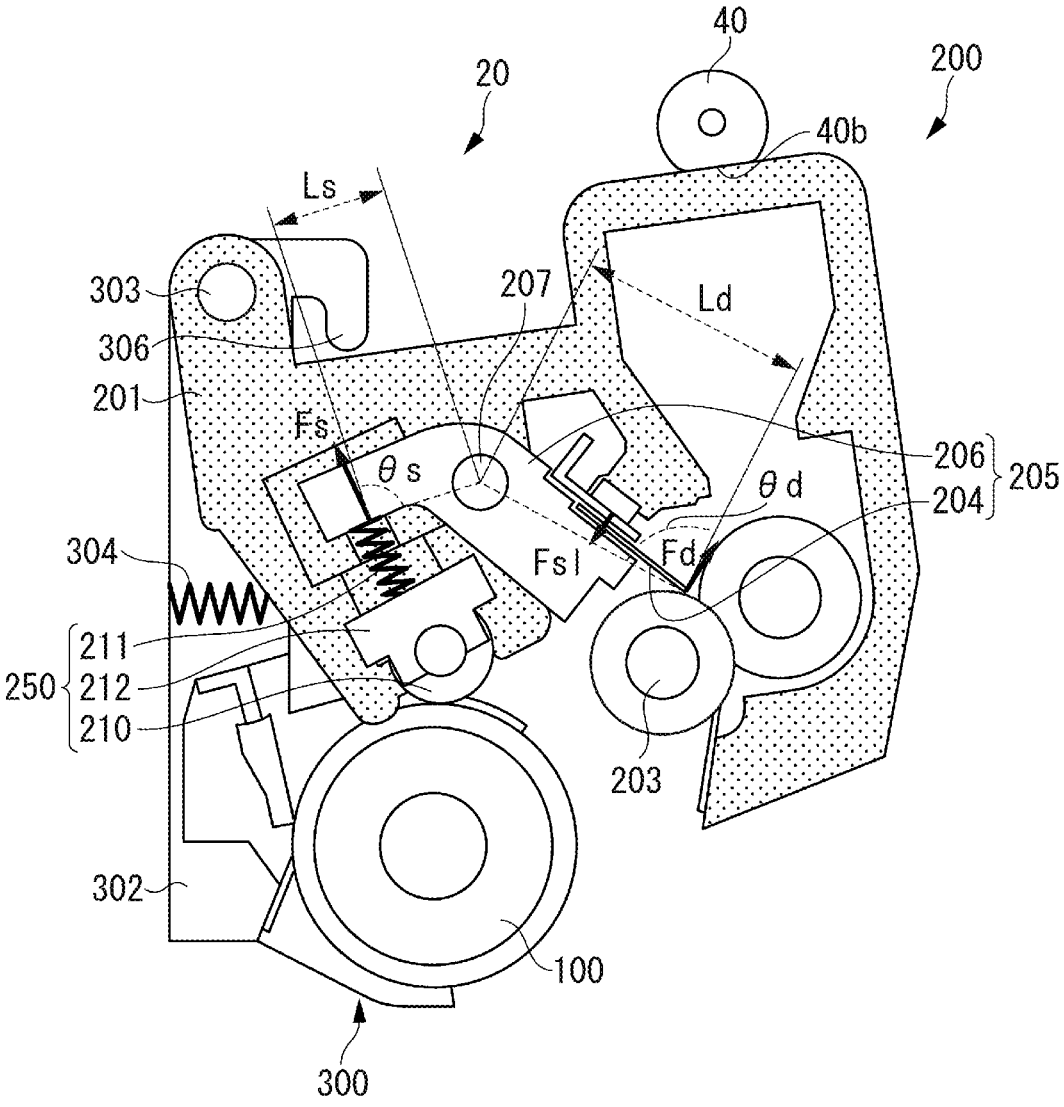
FIG. 5 is a schematic cross sectional view illustrating the process cartridge with a force to be applied to the swing unit when the developing roller and the photosensitive drum are separated from each other.

FIG. 5 illustrates a force to be applied to the swing unit 205 when the developing unit 200 is in a separation position.

When the developing unit 200 rotates from the contact position to the separation position, the charging roller 210 tends to move in a direction to separate from the photosensitive drum 100. However, since the charging roller bearing 212 is pressed by the pressure spring 211, the charging roller bearing 212 moves with respect to the development frame member 201, so that the charging roller 210 remains in contact with the photosensitive drum 100. The movement of the charging roller bearing 212 causes the pressure spring 211 to be more stretched than that of when the developing unit 200 is in the contact position (see FIG. 4).

The stretch of the pressure spring 211 reduces a pressing force to be applied to swing frame member 206. Such reduction of the force reduces a pressing force to be applied to the developing roller 203 by the developing blade 204 fixed to the swing frame member 206.

Such reduction is described using equation (1). When the developing unit 200 moves from the contact position to the separation position, the force Fs to be applied by the pressure spring 211 to the swing frame member 206 is reduced on the right side of equation (1). Herein, since the swing unit 205 is not moving with respect to the development frame member 201, the length Ld, angle θd, length Ls, and angle θs are constant. Accordingly, when the force Fs is reduced, the force Fd on the left side slightly changes to balance equation (1). Therefore, the pressing force applied by the developing blade 204 to the developing roller 203 can be reduced.

In addition to the forces Fs and Fd, there are cases where the swing unit 205 is, for example, applied with a force Fs1 (see FIG. 5) from the sealing member 220, which contacts the developing blade 204. Since the force Fs1 is smaller than the forces Fs and Fd, the force Fs1 has been ignored in equation (1). However, even if, for example, the force Fs1 cannot be ignored, a relationship between the forces Fs and Fd holds as a moment to be added to the swing unit 205 remains balanced, the relationship being that reduction of the force Fs by movement of the developing unit 200 to the separation position reduces the force Fd.

Therefore, the swing frame member 206 is urged by the first urging unit 250 including the charging roller 210, the charging roller bearing 212, and the pressure spring 211 disposed in the developing unit 200. The developing blade 204 supported by the swing frame member 206 is pressed against the developing roller 203 by such an urging force of the first urging unit 250.

Herein, when the developing unit 200 moves from the contact position to the separation position, the pressure spring 211 is stretched to cause the charging roller 210 to contact the photosensitive drum 100, thereby reducing an urging force to be applied by the first urging unit 250 to the swing frame member 206. Such reduction of the force reduces a pressing force to be applied by the developing blade 204 to the developing roller 203.

On the other hand, when the developing unit 200 moves from the separation position to the contact position, the charging roller 210 is pressed against the photosensitive drum 100, thereby compressing the pressure spring 211. Such compression of the pressure spring 211 increases an urging force to be applied by the first urging unit 250 to the swing frame member 206, and the increase in the urging force increases the pressing force of the developing blade 204. Accordingly, the developing blade 204 can appropriately regulate a thickness of a toner layer to be formed on the developing roller 203.

In an image forming apparatus in general, a standby time elapsed for not forming an image is longer than an image formation time elapsed for forming an image. Thus, the ratio of the standby time to the total time is greater than that of the image forming time. According to the present exemplary embodiment, the developing unit 200 is moved to the separation position at the standby time, so that the developing roller 203 separates from the photosensitive drum 100. Such a movement of the developing unit 200 suppresses the deformation of the developing roller 203 caused by the photosensitive drum 100. Consequently, the developing roller 203 can reduce phenomena of depression and deformation thereof. Moreover, since the pressing force of the developing blade 204 is changed with the movement of the developing unit 200, an additional mechanism for changing the pressing force of the developing blade 204 is not necessarily disposed.

Specifically, when the developing blade 204 is made of metal as the present exemplary embodiment, the developing roller 203 tends to be deformed by a pressing force applied by the developing blade 204. Consequently, the reduction of the pressing force of the developing blade 204 during the standby time is effective.

Even when the developing unit 200 is in the separation position, the developing blade 204 is not separated from the developing roller 203 and is in contact with the developing roller 203. Such an arrangement of the developing blade 204 can suppress leakage of a toner from a portion between the developing blade 204 and the developing roller 203 to the outside of the process cartridge 20. In the present exemplary embodiment, that is, when the developing unit 200 is in the separation position, the pressing force of the developing blade 204 is reduced to a certain level at which the toner is not leaked to the outside of the process cartridge 20.

In the present exemplary embodiment, moreover, the movement of the developing unit 200 to the separation position reduces an urging force to be applied by the pressure spring 211 to the charging roller bearing 212, thereby reducing a force for pressing the charging roller 210 against the photosensitive drum 100. Accordingly, the charging roller 210 can suppress deformation thereof due to the force applied from the photosensitive drum 100. In the present exemplary embodiment, even when the developing unit 200 is moved to the separation position, the charging roller 210 remains in contact with the photosensitive drum 100, so that the charging roller 210 and the charging roller bearing 212 are not removed from the development frame member 201.

In addition, the developing unit 200 is urged by the separation spring 304 to rotate from the contact position to the separation position. When the process cartridge 20 is detached from the apparatus main body 10, the development frame member 201 rotates until contacting a rotation stopper 306 (see FIG. 5) disposed on the development frame member 201, and the developing unit 200 is moved to the separation position. Thus, the pressing force to be applied by the developing blade 204 to the developing roller 203 is reduced. Consequently, even when the process cartridge 20 is stored outside the apparatus main body 10 for a long period, the deformation of the developing roller 203 can be suppressed.

In the process cartridge 20 according the present exemplary embodiment, therefore, the swing frame member 206 presses the developing blade 204 against the developing roller 203 by using the force applied from the photosensitive drum 100 to the charging roller 210. When an image is not formed, therefore, the process cartridge 20 can simultaneously reduce a contacting pressure between the photosensitive drum 100 and the charging roller 210 and a contacting pressure between the developing roller 203 and the developing blade 204, thereby suppressing deformation of the charging roller 210 and the developing roller 203.

Figure 14A:
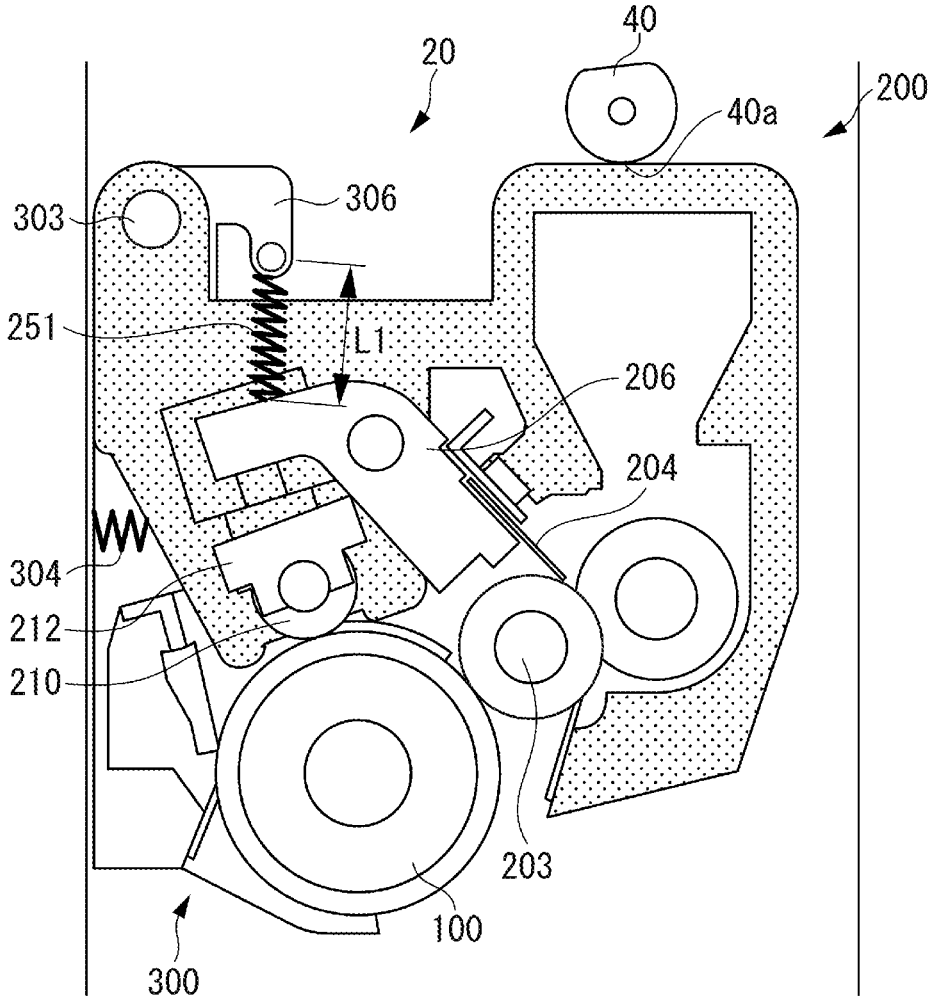
FIGS. 14A and 14B are schematic cross sectional views illustrating a process cartridge according to a second exemplary embodiment.
Figure 14B:
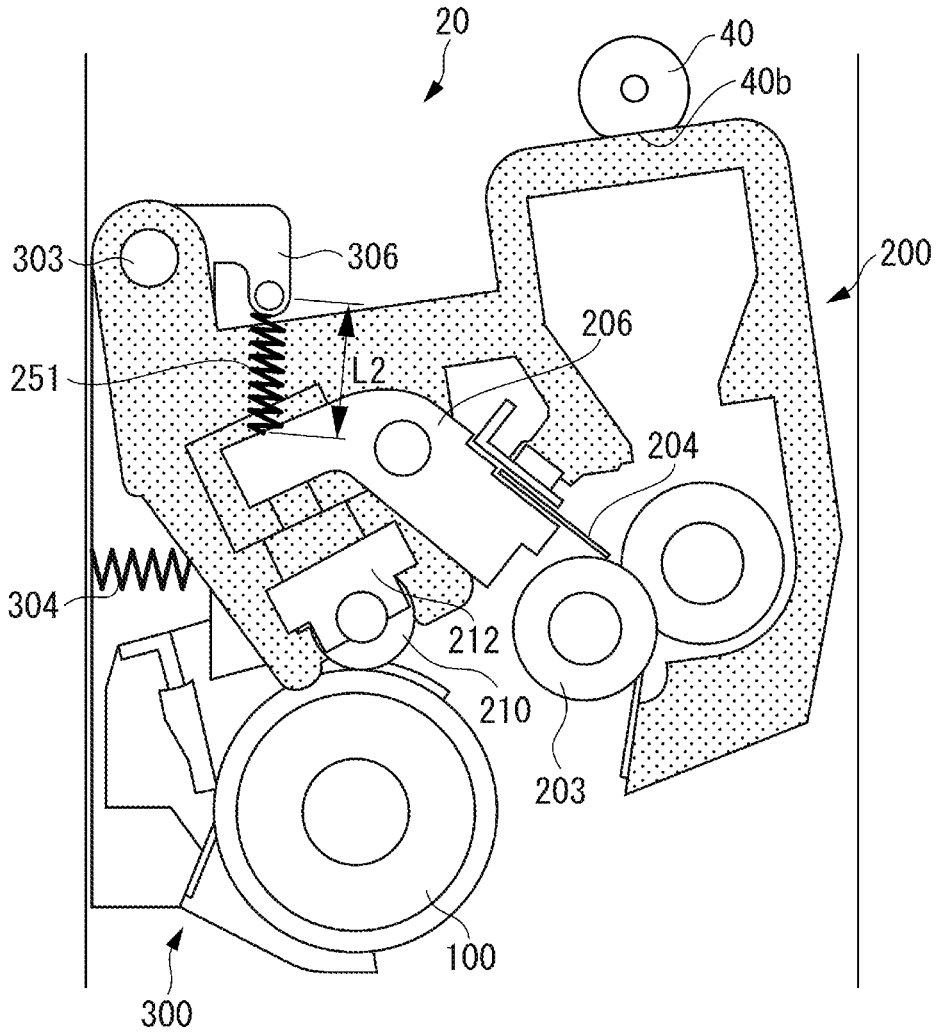

FIGS. 14A and 14B are schematic cross sectional views illustrating a process cartridge 20 according to a second exemplary embodiment. Components and configurations of the process cartridge 20 that differ from those of the first exemplary embodiment will be described, and like components will be given the same reference numerals as above and description thereof will be omitted.

FIG. 14A is a cross sectional view illustrating the process cartridge 20 when a developing unit 200 is in a contact position to cause a developing roller 203 to contact a photosensitive drum 100. FIG. 14B is a cross sectional view of the process cartridge 20 when the developing unit 200 is in a separation position to cause the developing roller 203 to separate from the photosensitive drum 100.

In the first exemplary embodiment, the pressure spring 211 disposed between the swing frame member 206 and the charging roller bearing 212 is used. According to the second exemplary embodiment, an extension spring 251 is used instead of the pressure spring 211 to press the swing frame member 206. Both ends of the extension spring 251 are fixed to a rotation stopper 306 disposed on a C frame member 302 and the swing frame member 206. The extension spring 251 functions as an urging unit for urging the swing frame member 206 in a direction to press a developing blade 204 against the developing roller 203.

As illustrated in FIG. 14A, when the developing unit 200 is in the contact position, one end of the extension spring 251 is extended by the rotation stopper 306, so that the extension spring 251 urges the swing frame member 206 in a clockwise direction. Accordingly, the developing blade 204 fixed to the swing frame member 206 is pressed against the developing roller 203.

When the developing unit 200 moves from the contact position illustrated in FIG. 14A to the separation position illustrated in FIG. 14B, a length between the rotation stopper 306 and the swing frame member 206 is shortened, and thus a stretch amount of the extension spring 251 is reduced. More specifically, the length of the extension spring 251 changes from a length L1 illustrated in FIG. 14A to a length L2 illustrated in FIG. 14B. Herein, the length L1 is greater than the length L2 (L1>L2). Consequently, an amount of urging force to be applied by the extension spring 251 to the swing frame member 206 is reduced, and a pressing force to be applied by developing blade 204 to the developing roller 203 is also reduced.

Thus, the pressing force of the developing blade 204 with respect to the developing roller 203 is reduced in conjunction with the movement of the developing unit 200 to the separation position, thereby suppressing phenomena of deformation of the developing roller 203 due to the developing blade 204.

According to the present exemplary embodiment, the extension spring 251, serving as an urging unit, is connected to the swing frame member 206 and the C frame member 302, so that the swing frame member 206 and the C frame member 302 are directly linked. Thus, the movement of the developing unit 200 with respect to the C frame member 302 surely changes an urging force applied by the extension spring 251 to the swing frame member 206. More specifically, the movement of the developing unit 200 from the contact position (see FIG. 14A) to the separation position (see FIG. 14B) surely reduces the urging force applied by the extension spring 251 to the swing frame member 206. Consequently, the pressing force to be applied by the developing blade 204 to the developing blade 204 can be surely reduced.

Figure 10:
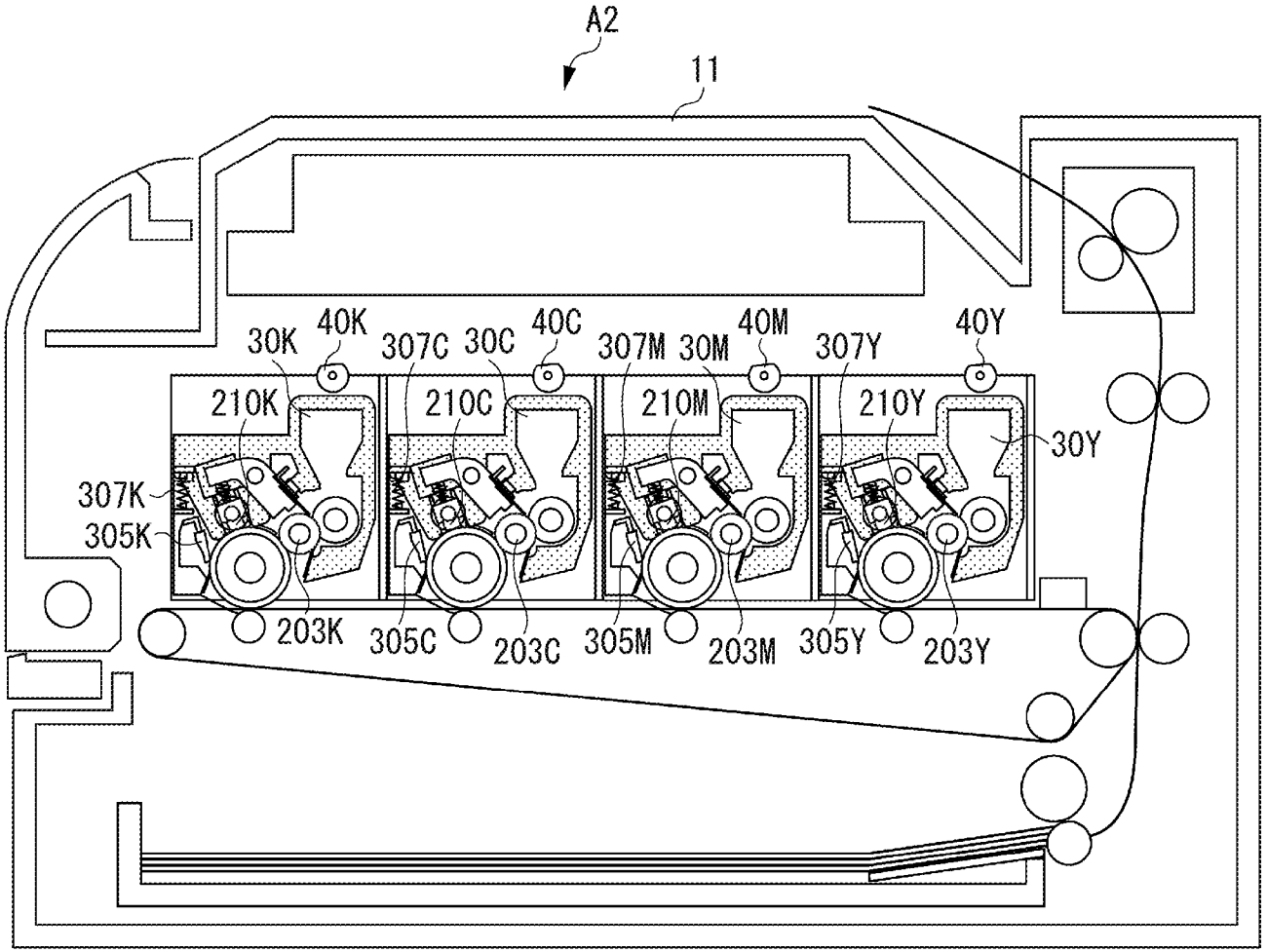
FIG. 10 is a schematic cross sectional view illustrating an image forming apparatus according to the third exemplary embodiment.

FIG. 10 is a schematic cross sectional view illustrating an image forming apparatus A2 according to a third exemplary embodiment. Components and configurations of the image forming apparatus A2 that differ from those of the first exemplary embodiment will be described, and like components will be given the same reference numerals as above and description thereof will be omitted.

In the image forming apparatus A2 according to the third exemplary embodiment, an image forming unit includes a development cartridge 30 including a developing roller 203, and a C unit 305 including a photosensitive drum 100 as illustrated in FIG. 10.

Figure 6A:
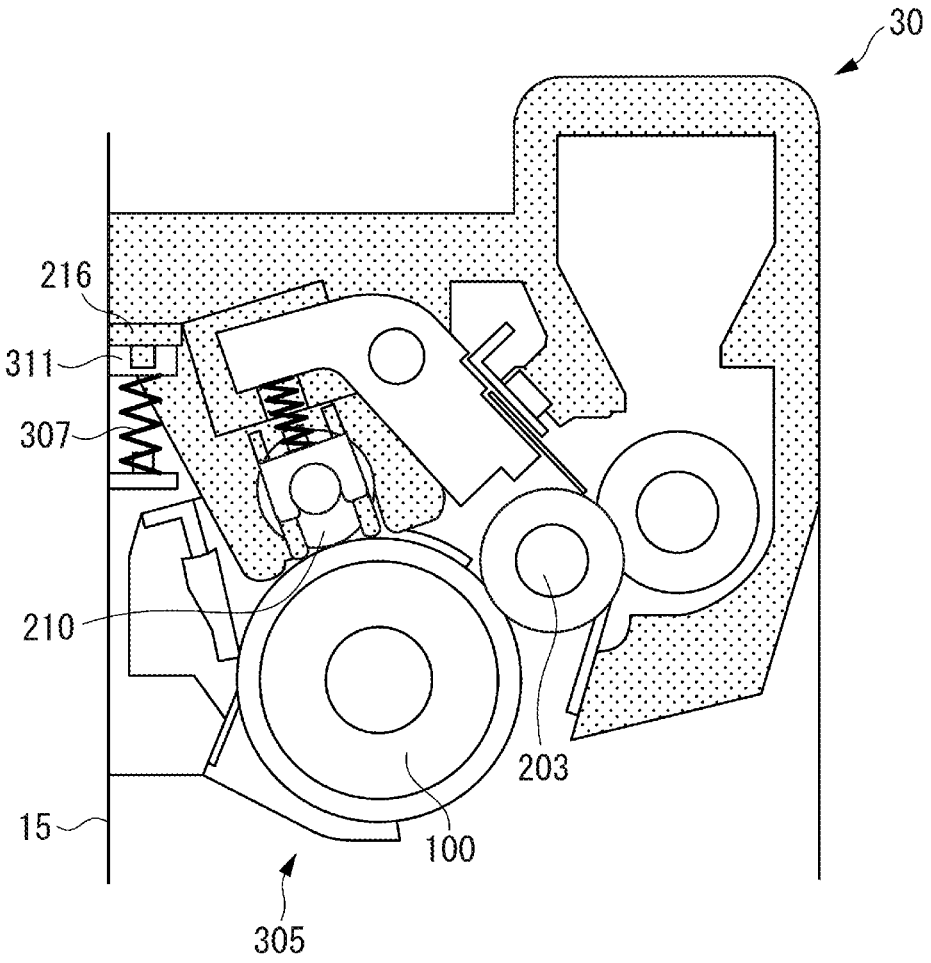
FIGS. 6A and 6B are schematic cross sectional views illustrating connection and separation of a development cartridge and a C unit.
Figure 6B:
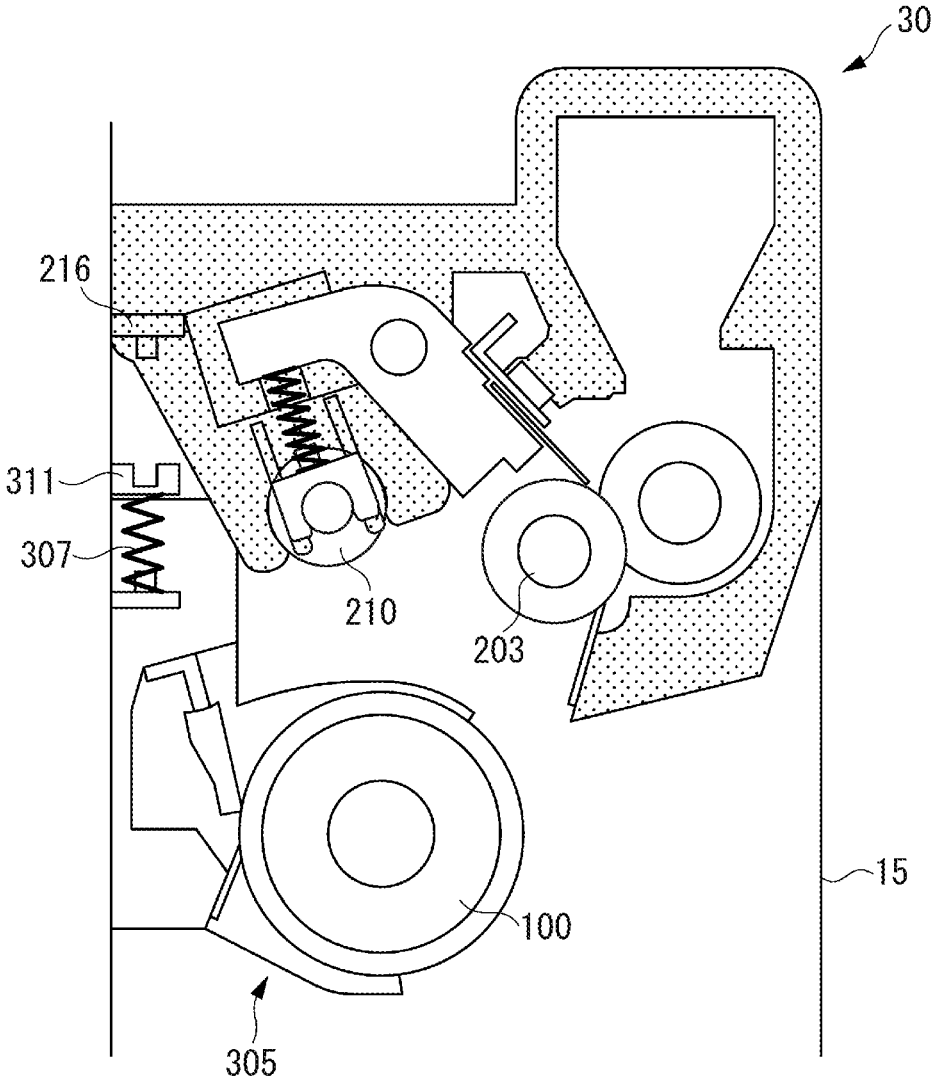

The development cartridge 30 is a developing device which includes a developing unit formed as a cartridge and is attachable and detachable with respect to an apparatus main body 11 of the image forming apparatus A2. As illustrated in FIGS. 6A and 6B, the development cartridge 30 can be separated from the C unit 305. FIG. 6A is a schematic cross sectional view illustrating a connection state of the development cartridge 30 and the C unit 30, whereas FIG. 6B illustrates a separation state of the development cartridge 30 and the C unit 305.

When a toner stored in the development cartridge 30 is used up, only the development cartridge 30 can be replaced, whereas the C unit 305 can be continued to be used.

Figure 7:
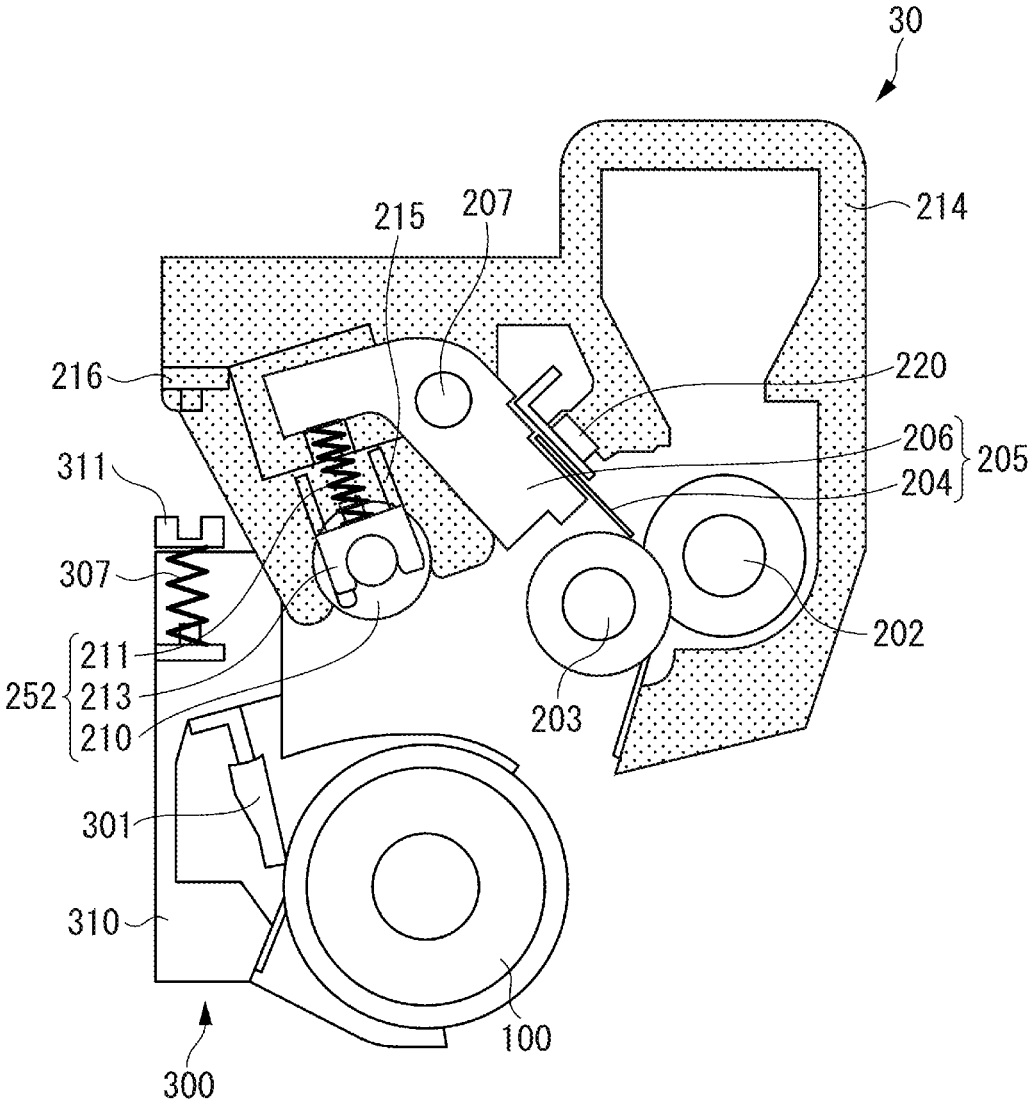
FIG. 7 is a schematic cross sectional view illustrating a development cartridge and a C unit according to a third exemplary embodiment.

FIG. 7 is a cross sectional view illustrating the development cartridge 30 and the C unit 305. As illustrated in FIG. 7, the development cartridge 30 includes a development cartridge frame member 214 as a frame member for supporting various components provided inside the development cartridge 30. The development cartridge frame member 214 rotatably supports the developing roller 203. A charging roller bearing 213 is movably disposed on the development cartridge frame member 214, and supports the charging roller 210. One end of a pressure spring 211 is attached to the charging roller bearing 213. When the charging roller bearing 213 is attached to the apparatus main body 11, the charging roller 210 is pressed against the photosensitive drum 100 by the pressure spring 211.

A sealing member 220 is disposed on the development cartridge frame member 214. The sealing member 220 contacts the developing blade 204 so that a toner inside the development cartridge frame member 214 is sealed to prevent leakage of the toner to the outside of the developing unit 200.

Figure 8:
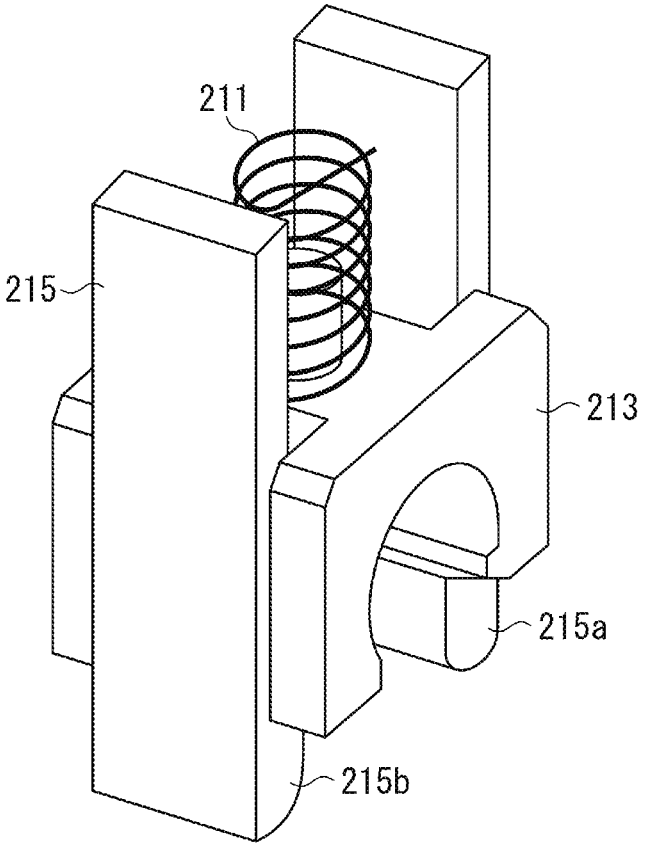
FIG. 8 is an enlarged perspective view illustrating a charging roller bearing and a snap-fit member according to the third exemplary embodiment.

Moreover, the development cartridge frame member 214 includes a snap-fit member 215 serving as a guide member for guiding a movement of the charging roller bearing 213. FIG. 8 is an enlarged perspective view illustrating a case where the charging roller bearing 213 is mounted on the development cartridge frame member 214. The charging roller bearing 213 is movably mounted on the development cartridge frame member 214 through the snap-fit member 215. The snap-fit member 215 includes regulation portions 215*a* and 215*b* for regulating a movement of the charging roller bearing 213 in a direction to move away from the development cartridge frame member 214 by contacting the charging roller bearing 213. Thus, when the development cartridge 30 is separated from the C unit 305, the charging roller bearing 213 is not removed from the development cartridge frame member 214.

On the other hand, the C unit 305 includes a separation spring 307 as illustrated in FIG. 7. The separation spring 307 separates the developing roller 203 from the photosensitive drum 100 when the C unit 305 is connected to the development cartridge 30. The separation spring 307 is a compression spring, and one end thereof is attached to a frame member (hereinafter called a C frame member) 310 of the C unit 305, whereas the other end is provided with an engagement member 311 having a recessed portion. When the development cartridge 30 is connected to the C unit 305, the engagement member 311 engages with an engagement portion 216 of the development cartridge 30. The engagement portion 216 has a raised portion to be engaged with the recessed portion of the engagement member 311.

Figure 12:
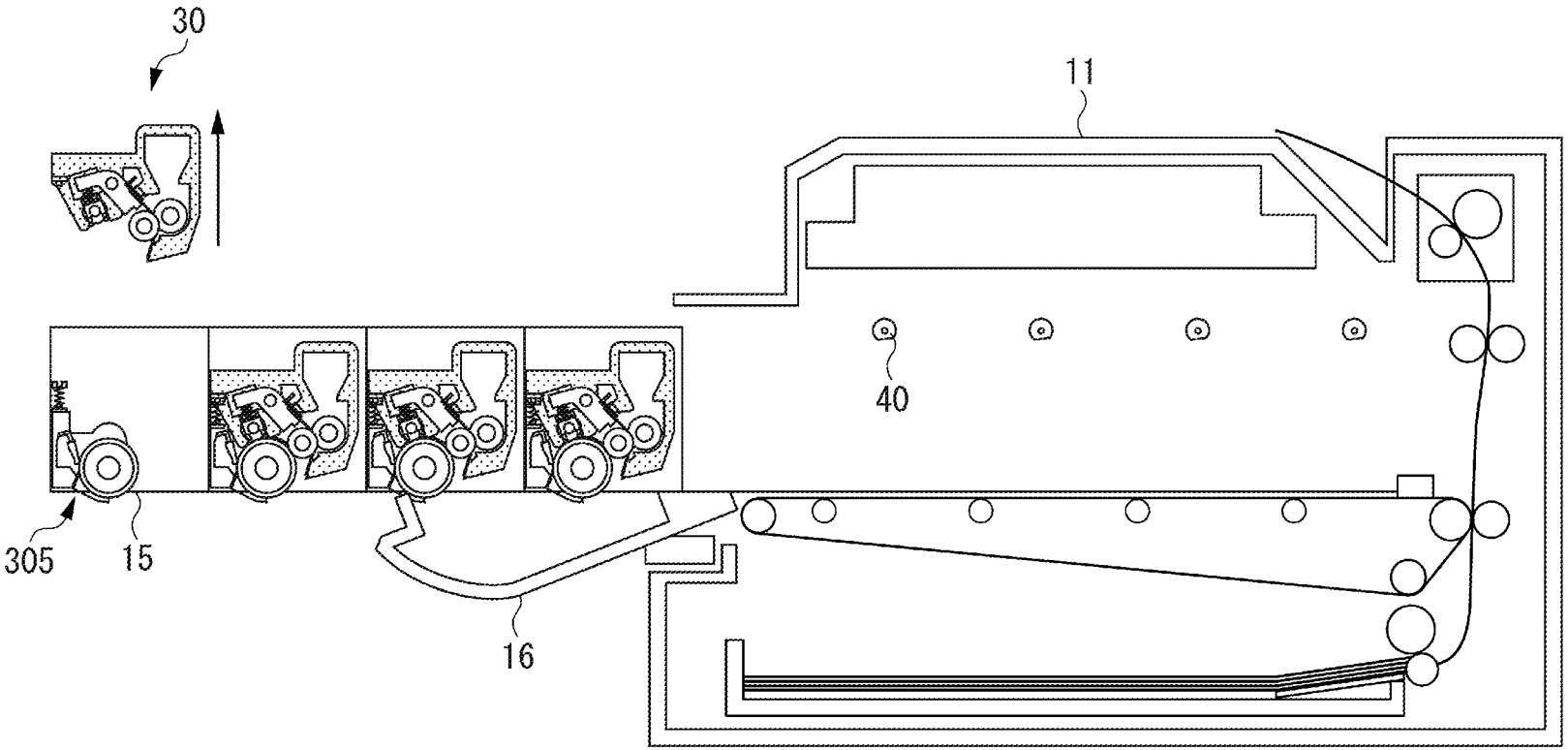
FIG. 12 is a schematic cross sectional view illustrating an operation of attaching a development cartridge to an apparatus main body.

Now, a description is given of a method for attaching the development cartridge 30 to the apparatus main body 11 with reference to FIGS. 6A, 6B, and 12. FIG. 12 illustrates a schematic cross sectional view of the apparatus main body 11 when a cartridge tray 15 is pulled out.

As illustrated in FIG. 12, the apparatus main body 11 includes the cartridge tray 15 capable of being pulled out from inside thereof. In the present exemplary embodiment, the C unit 305 is removably fixed to the cartridge tray 15.

When the development cartridge 30 is attached to the apparatus main body 11, the cartridge tray 15 is first pulled out from the apparatus main body 11. The development cartridge 30 is then attached to the cartridge tray 15 from above, and is connected to the C unit 305 as illustrated in FIG. 6B.

When the development cartridge 30 is attached to the cartridge tray 15, the engagement portion 216 of the development cartridge 30 engages with the engagement member 311 of the C unit 305 as illustrated in FIG. 6A. Moreover, the charging roller 210 contacts the photosensitive drum 100, so that the development cartridge 30 is connected to the C unit 305.

The separation spring 307 is attached to the frame member 310 and is connected to the development cartridge 30 through the engagement member 311. However, the separation spring 307 may be attached to the development cartridge frame member 214, so that the separation spring 307 can be connected to or separated from the frame member 310.

When the cartridge tray 15 is pushed inside the apparatus main body 11 while the development cartridge 30 is being connected to the C unit 305, the development cartridge 30 and the C unit 305 are attached in a position capable f forming an image.

Figure 13A:
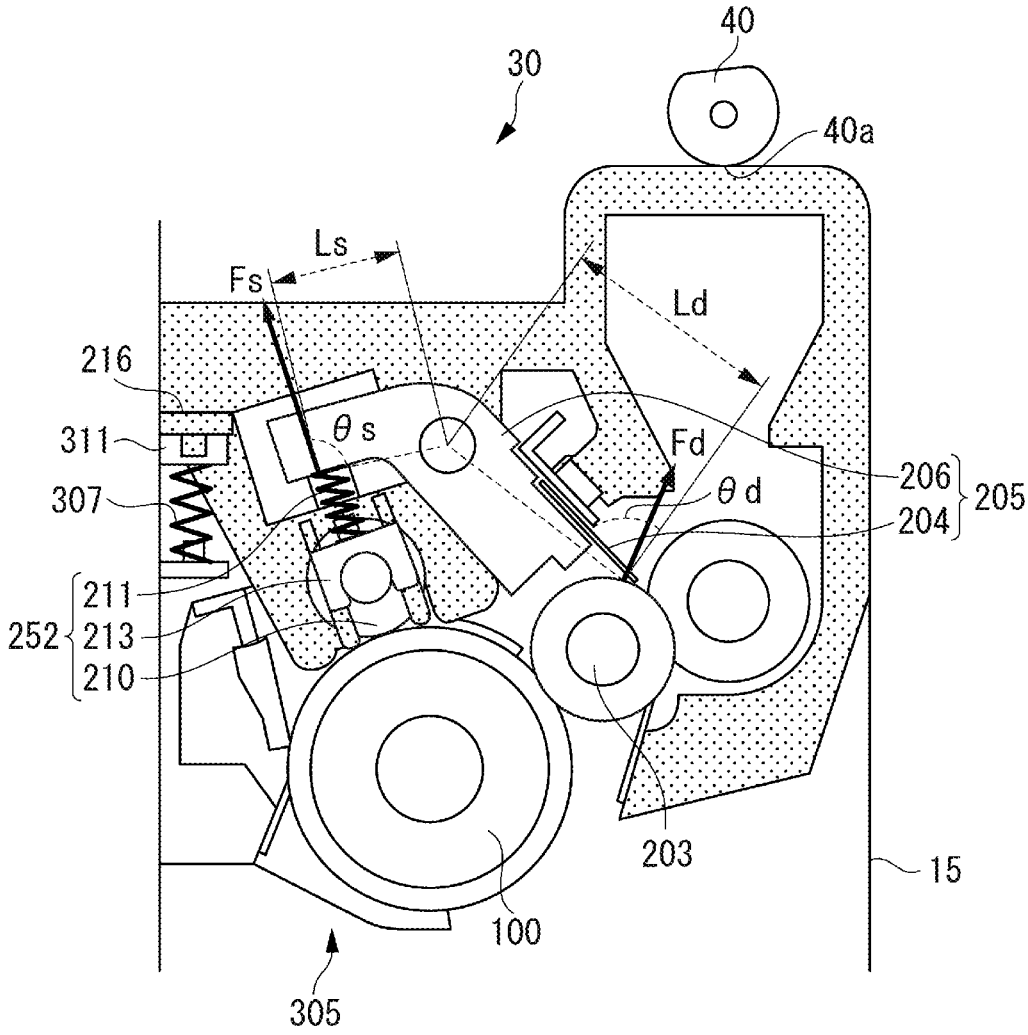
FIGS. 13A and 13B are diagrams illustrating a force to be applied to a swing unit according to the third exemplary embodiment.
Figure 13B:
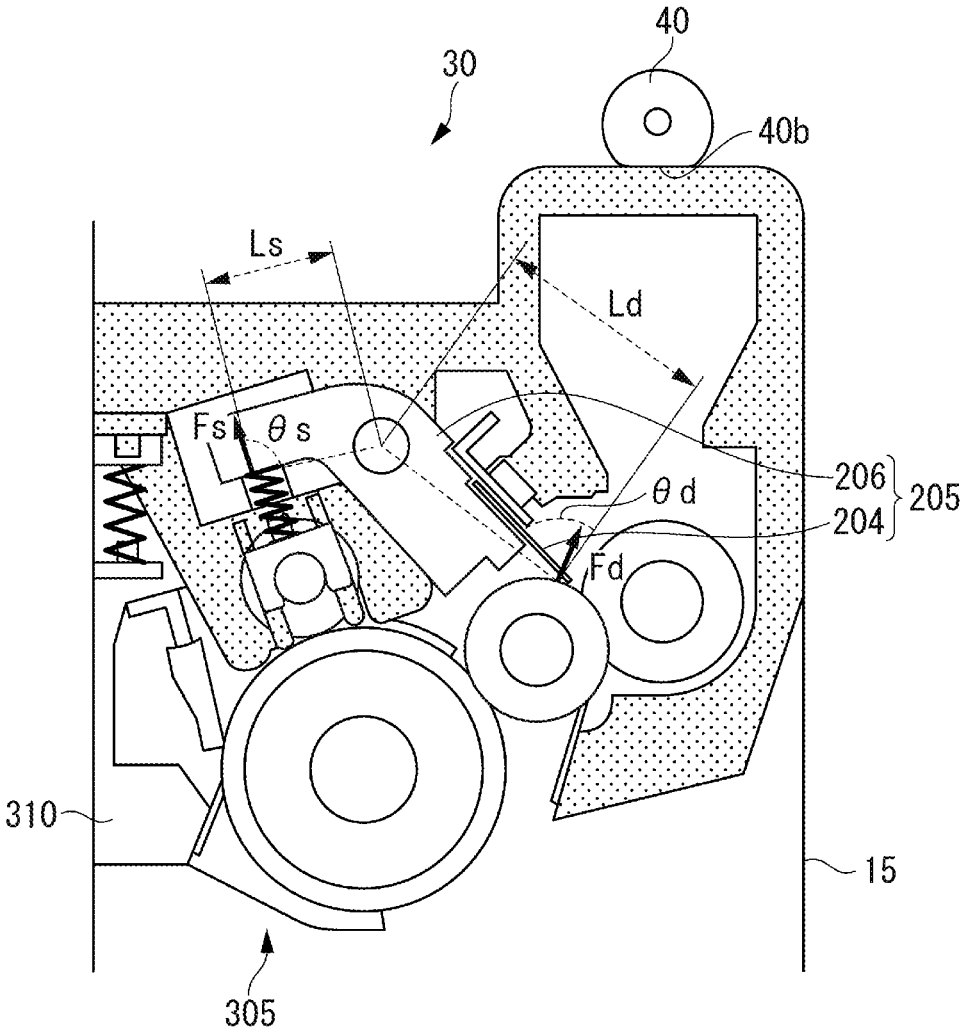

Referring to FIGS. 13A and 13B, a description is given of a method for contacting and separating the developing roller 203 and the photosensitive drum 100 in the apparatus main body 11. FIGS. 13A and 13B are schematic cross sectional views illustrating the development cartridge 30 and the C unit 305 attached to the apparatus main body 11.

The development cartridge 30 is attached to the cartridge tray 15 such that the development cartridge 30 is vertically sildable. When an image is formed, a pressure cam 40 is rotated, so that a raised portion 40*a* thereof contacts and presses the development cartridge 30 downward. Upon being pressed downward, the development cartridge 30 slides and moves downward to a contact position in which the developing roller 203 contacts the photosensitive drum 100 (see FIG. 13A). A movement of the pressure cam 40 is substantially the same as that described with the sequence diagram illustrated in FIG. 3 in the first exemplary embodiment.

The movement of the development cartridge 30 to the contact position causes the charging roller 210 to contact the photosensitive drum 100, and the charging roller 210 and the charging roller bearing 213 are pushed into the development cartridge frame member 214 by receiving a force. Accordingly, the pressure spring 211 being in contact with the charging roller bearing 213 is compressed, thereby applying a force Fs to the swing frame member 206. The force Fs urges the swing frame member 206 in a clockwise direction about a swing fulcrum shaft 207, and the swing frame member 206 presses the developing blade 204 against the developing roller 203.

In the present exemplary embodiment, therefore, the charging roller 210, the charging roller bearing 213, and the pressure spring 211 serve as an urging unit 252 for urging the swing frame member 206 to press the developing blade 204 against the developing roller 203.

Moreover, when the developing blade 204 presses the developing roller 203, a force Fd is applied to the swing unit 205 by reaction thereof. Herein, a moment about the swing fulcrum shaft 207 to be added to the swing unit 205 including the swing frame member 206 and the developing blade 204 is balanced, and equation (1) holds.

When an image formation is finished, the pressure cam 40 rotates until the raised portion 40*a* is oriented upward. Herein, since a force applied from the pressure cam 40 is reduced, the development cartridge 30 slides upward by a pressing force of the separation spring 307 until contacting the recessed portion 40*b* of the pressure cam 40. Accordingly, the development cartridge 30 moves to a separation position to cause the developing roller 203 to separate from the photosensitive drum 100 (see FIG. 13B). Although the charging roller 210 moves in a direction to separate from the photosensitive drum 100 in conjunction with the movement of the development cartridge 30, the charging roller 210 remains in contact with the photosensitive drum 100 by the press of the charging roller bearing 213 by the pressure spring 211. Herein, the pressure spring 211 is more stretched than that of when the development cartridge 30 is in the contact position.

The stretch of the pressure spring 211 reduces a force Fs to be applied thereby to press the swing frame member 206. Such reduction of the force reduces a pressing force to be applied to the developing roller 203 by the developing blade 204 fixed to the swing frame member 206.

A change in an amount of force to be applied by the developing blade 204 to the developing roller 203 is described using equation (1). When the development cartridge 30 is moved from the contact position to the separation position, on the right side of equation (1), a force Fs to be applied by the pressure spring 211 to the swing frame member 206 is reduced. Herein, since the swing unit 205 is positioned with respect to the development cartridge frame member 214, a length Ls, an angle θs, a length Ld, and an angle θd are constant in spite of the movement of the development cartridge 30 to the separation position. Therefore, when the force Fs is reduced, the force Fd on the left side of equation (1) is reduced to balance equation (1). Herein, the force Fd is equal to a pressing force to be applied by the developing blade 204 to the developing roller 203. Therefore, when an image is not formed, a pressing force applied by the developing blade 204 to the developing roller 203 is reduced, thereby suppressing deformation of the developing roller 203.

As illustrated in FIG. 7, since the charging roller 210 is separated from the photosensitive drum 100 when the development cartridge 30 is separated from the C unit 305, the pressure spring 211 is more stretched than that of when the development cartridge 30 is in the contact position. However, since the regulation portions 215*a* and 215*b* of the snap-fit member 215 regulate the movement of the charging roller bearing 213, the pressure spring 211 cannot be stretched to a natural length thereof. Therefore, the force Fs to be applied by the pressure spring 211 to the swing frame member 206 cannot be zero. Accordingly, although the pressing force to be applied by the developing blade 204 to the developing roller 203 is reduced, the developing blade 204 and the developing roller 203 remain in contact with each other. Even when the development cartridge 30 is detached from the apparatus main body 11, a toner leakage from a portion between the developing blade 204 and the developing roller 203 to the outside of the process cartridge 20 can be suppressed.

In the present exemplary embodiment, moreover, the detachment of the development cartridge 30 from the apparatus main body 11 can suppress deformation of the charging roller 210 due to being in contact with photosensitive drum 100 for a long time.

Configurations of the charging roller bearing 213, the snap-fit member 215, and the regulation portions 215*a* and 215*b* according to the present exemplary embodiment may be used in the developing unit 200 of the first and second exemplary embodiments (see FIG. 1). More specifically, the developing unit 200 of the first and second exemplary embodiments may include a regulation portion for regulating a movement of a charging roller bearing. Such a regulation portion can engage with a charging roller bearing when the developing unit 200 is in the separation position, and can serve as a portion for regulating a movement of the charging roller 210 in a direction to move away from the development frame member 201.

Figure 15A:
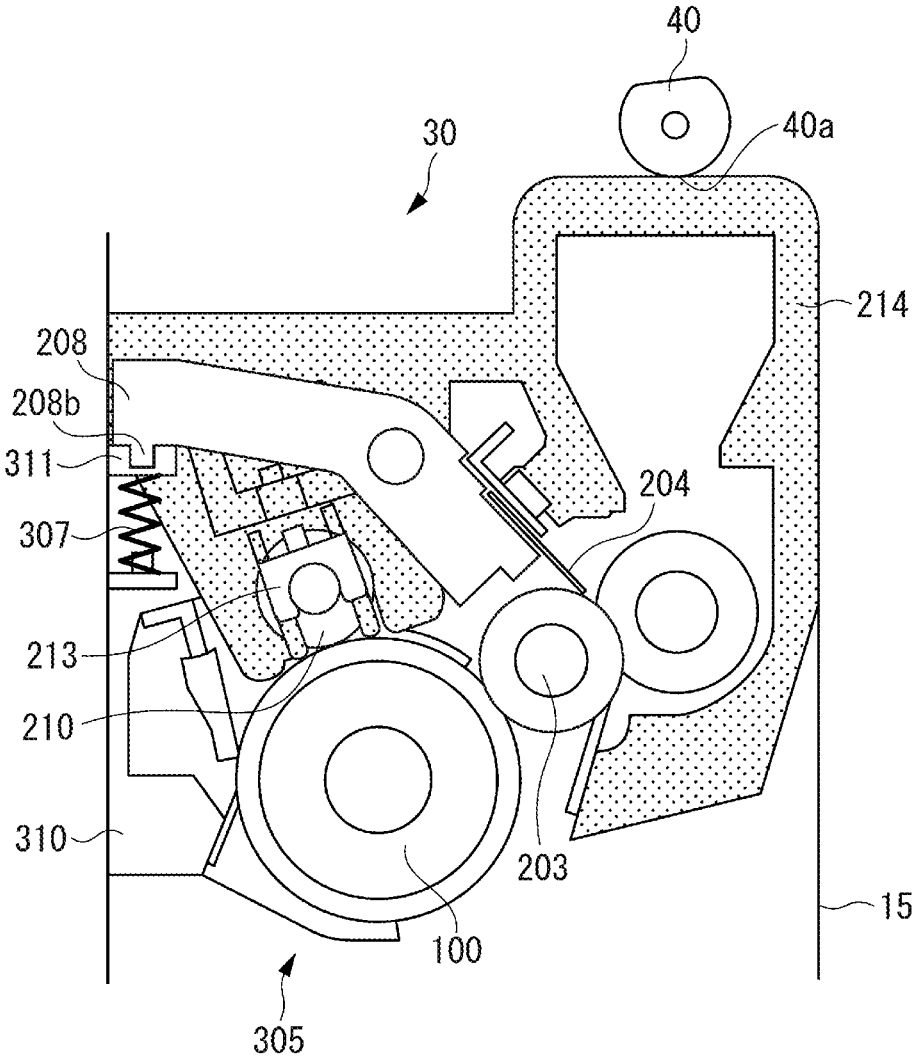
FIGS. 15A and 15B are schematic cross sectional views illustrating a development cartridge and a C unit according to a fourth exemplary embodiment.
Figure 15B:
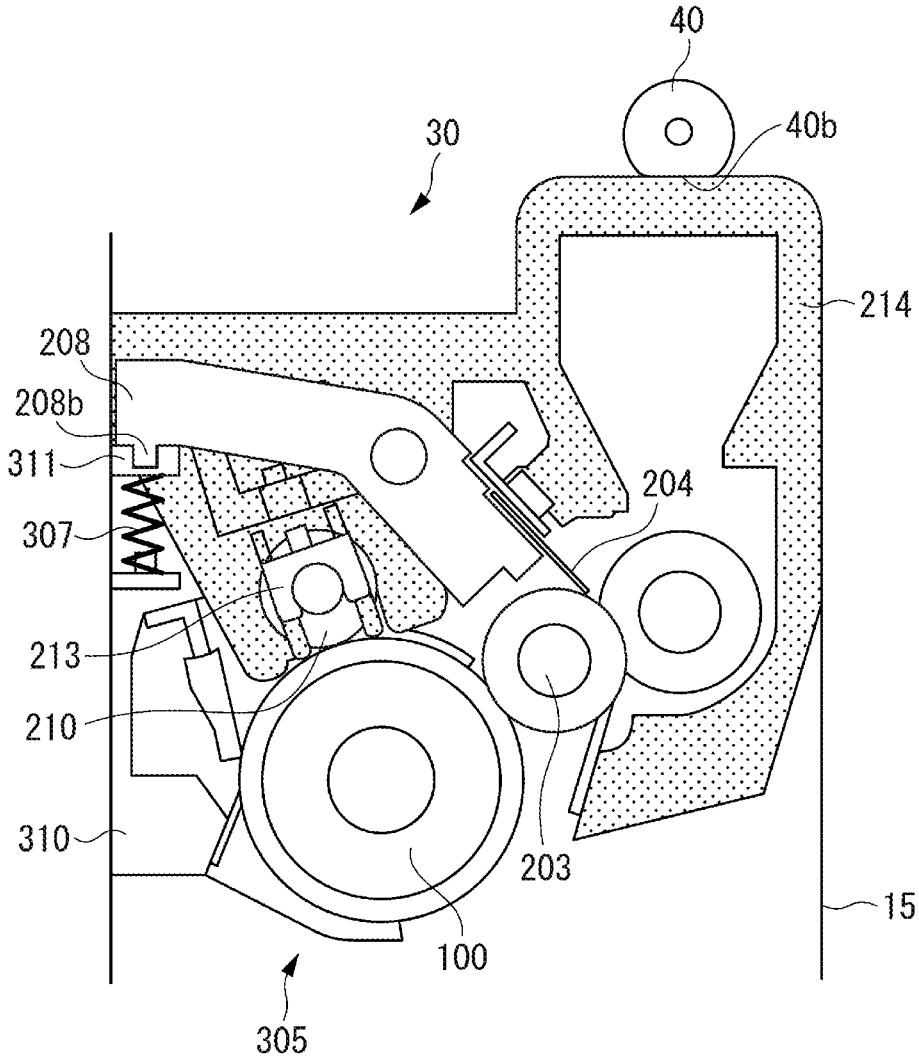

FIGS. 15A and 15B are schematic cross sectional views illustrating a development cartridge 30 and a C unit 305 according to a fourth exemplary embodiment. Components similar to those of the third exemplary embodiment are given the same reference numerals as above and the description thereof is omitted.

FIG. 15A illustrates a state that the development cartridge 30 is in a contact position to cause a developing roller 203 to contact a photosensitive drum 100. FIG. 15B illustrates a state that the development cartridge 30 is in a separation position to cause the developing roller 203 to separate from the photosensitive drum 100.

In the present exemplary embodiment, a swing frame member 208 for supporting a developing blade 204 is capable of being engaged with a separation spring 307. The swing frame member 208 is a movable member and is disposed on the development cartridge 30 as similar to the swing frame member 206 according to the third exemplary embodiment.

The swing frame member 208 has an engagement portion 208*b* having a raised portion. When the development cartridge 30 is connected to the C unit 305, the engagement portion 208*b* engages with an engagement member 311 disposed on an edge of the separation spring 307. The development cartridge 30 is attached to an apparatus main body 11 in a state that the swing frame member 208 is engaged with the separation spring 307.

Since the separation spring 307 is a compression coil spring and pushes the development cartridge 30 upward through the swing frame member 208, the development cartridge 30 can move vertically inside the apparatus main body 11. Therefore, the development cartridge 30 can be in the contact position and the separation position by rotation of a pressure cam 40 as similar to that of the third exemplary embodiment.

As illustrated in FIG. 15A, when a raised portion 40*a* of the pressure cam 40 contacts the development cartridge 30, the development cartridge 30 is pushed and moved downward by the raised portion 40*a* to the contact position to cause the developing roller 203 to contact the photosensitive drum 100. Herein, the movement of the development cartridge 30 to the contact position compresses the separation spring 307 as the development cartridge 30 approaches the C unit 305. Accordingly, the swing frame member 208 is urged clockwise by receiving an urging force from the separation spring 307, and presses the developing blade 204 against the developing roller 203. In the present exemplary embodiment, the separation spring 307 is an urging unit for urging the swing frame member 208 in a direction to press the developing blade 204 against the developing roller 203.

On the other hand, when the rotation of the pressure cam 40 separates the raised portion 40*a* from the development cartridge 30 as illustrated in FIG. 15*b*, a force to be applied by the pressure cam 40 to push the development cartridge 30 downward is reduced. Such reduction of the force causes the development cartridge 30 to lift upward with a force applied by the separation spring 307 to the swing frame member 208, and the developing roller 203 is separated from the photosensitive drum 100. Thus, the development cartridge 30 is moved to the separation position.

Herein, the movement of the development cartridge 30 to the separation position causes the separation spring 307 to be more stretched than that of when the development cartridge 30 is in the contact position. Consequently, an urging force to be applied to the swing frame member 208 is reduced, thereby reducing the pressing force to be applied to the developing roller 203 by the developing blade 204 supported by the swing frame member 208.

In the present exemplary embodiment, therefore, the separation spring 307 for separating the developing roller 203 from the photosensitive drum 100 is engaged with the swing frame member 208 through the engagement member 311, and is used as an urging unit for urging the swing frame member 208. Therefore, when an image is not formed, a pressing force applied by the developing blade 204 to the developing roller 203 is reduced, thereby suppressing deformation of the developing roller 203 as similar to the third exemplary embodiment. Alternatively, an urging unit other than the separation spring 307 may be engaged with the swing frame member 208. In such a case, the urging unit may be configured such that an urging force thereof is reduced when the development cartridge 30 is moved from the contact position to the separation position.

According to the present exemplary embodiment, the separation spring 307 serving as an urging unit is connected to the swing frame member 208 and the frame member 310, so that the swing frame member 208 and the frame member 310 are linked. Therefore, the movement of the development cartridge 30 with respect to the frame member 310 surely changes an urging force applied by the separation spring 307 to the swing frame member 208. Thus, the movement of the development cartridge 30 can surely change the urging force applied by the developing blade 204 to developing roller 203.

According to the present exemplary embodiment, the separation spring 307, serving as an urging unit, is attached to the frame member 310 of the C unit 305, and is engaged with the swing frame member 208 through the engagement member 311. However, an urging unit may be attached to the swing frame member 208, and then the urging member may be connected to or separated from the frame member 310. In other words, (1) an urging unit is attached to the swing frame member 208, and the urging unit is connectable to the frame member 310, or (2) an urging unit attached to the frame member 310 is connectable to the swing frame member 208.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-097439 filed Apr. 25, 2011, which is hereby incorporated by reference herein in its entirety.

What is claimed is:

1. A process cartridge detachably attachable to an apparatus main body of an image forming apparatus, the process cartridge comprising:

an image bearing member for bearing an electrostatic latent image;

a first frame member configured to support the image bearing member;

a developer bearing member configured to carry a developer for developing the electrostatic latent image;

a second frame member configured to support the developer bearing member;

a charging member configured to charge the image bearing member;

a developer regulating member configured to regulate an amount of the developer to be carried by the developer bearing member; and a moving member configured to be rotatably disposed on the second frame member and to support the developer regulating member, the moving member pressing the developer regulating member against the developer bearing member by a force received by contact of the charging member with the image bearing member.

2. The process cartridge according to claim 1, wherein the second frame member is rotatably coupled with the first frame member and is movable to a contact position to cause the developer bearing member to contact the image bearing member and a separation position to cause the developer bearing member to separate from the image bearing member, and wherein a movement of the second frame member from the contact position to the separation position causes the moving member to reduce a force for pressing the developer bearing member by the developer regulating member to be less than a force produced when the second frame member is in the contact position.

3. The process cartridge according to claim 2, wherein the second frame member includes a regulation portion configured to regulate a movement of the charging member when the second frame member is in the separation position.

4. The process cartridge according to claim 2, wherein when the second frame member moves from the contact position to the separation position the developer regulating member remains in contact with the developer bearing member.

5. The process cartridge according to claim 1, further comprising a pressing member configured to press the charging member against the image bearing member while pressing the moving member, the pressing member being positioned between the charging member and the moving member.

6. A process cartridge detachably attachable to an apparatus main body of an image forming apparatus, the process cartridge comprising:

an image bearing member for bearing an electrostatic latent image;

a first frame member configured to support the image bearing member;

a developer bearing member configured to carry a developer for developing the electrostatic latent image;

a second frame member configured to support the developer bearing member and to be rotatably coupled with the first frame member, the second frame member being movable to a contact position to cause the developer bearing member to contact the image bearing member and a separation position to cause the developer bearing member to separate from the image bearing member;

a developer regulating member configured to regulate an amount of the developer to be carried by the developer bearing member;

a moving member configured to be rotatably disposed on the second frame member and to support the developer regulating member; and an urging unit configured to urge the moving member to press the developer regulating member against the developer bearing member, the urging unit being attached to the first frame member and the moving member and reducing a force for pressing the developer regulating member against the developer bearing member to be less than a force produced when the second frame member is in the contact position by a movement of the second frame member from the contact position to the separation position.

7. The process cartridge according to claim 6, wherein when the second frame member moves from the contact position to the separation position the developer regulating member remains in contact with the developer bearing member.

8. A developing device for use in an image forming apparatus, the developing device comprising:

a developer bearing member configured to carry a developer for developing an electrostatic latent image to be formed on an image bearing member;

a frame member configured to support the developer bearing member;

a charging member configured to charge the image bearing member;

a developer regulating member configured to regulate an amount of the developer to be carried by the developer bearing member; and a moving member configured to be rotatably disposed on the frame member and to support the developer regulating member, the moving member pressing the developer regulating member against the developer bearing member by a force received by contact of the charging member with the image bearing member.

9. The developing device according to claim 8, wherein, when the developing device is in use in the image forming apparatus, the frame member is movable to a contact position to cause the developer bearing member to contact the image bearing member and a separation position to cause the developer bearing member to separate from the image bearing member, and wherein a movement of the frame member from the contact position to the separation position causes the moving member to reduce a force for pressing the developer regulating member against the developer bearing member to be less than a force produced when the frame member is in the contact position.

10. The developing device according to claim 9, wherein the frame member includes a regulation portion configured to regulate a movement of the charging member when the frame member is in the separation position.

11. The developing device according to claim 9, wherein, when the frame member moves from the contact position to the separation position, the developer regulating member remains in contact with the developer bearing member.

12. The developing device according to claim 8, further comprising a pressing member configured to press the charging member against the image bearing member while pressing the moving member, the pressing member being positioned between the charging member and the moving member.

13. A developing device used in an image forming apparatus including an image bearing member and a first frame member supporting the image bearing member, the developing device comprising:

a developer bearing member configured to carry a developer for developing an electrostatic image formed on the image bearing member;

a second frame member configured to support the developer bearing member and to be movable, when the developing device is in use in the image forming apparatus, to a contact position to cause the developer bearing member to contact the image bearing member and a separation position to cause the developer bearing member to separate from the image bearing member;

a developer regulating member configured to regulate an amount of the developer to be carried by the developer bearing member; and a moving member configured to be rotatably disposed on the second frame member and to support the developer regulating member, the moving member reducing a force for pressing the developer regulating member against the developer bearing member to be less than a force produced when the second frame member is in the contact position by a movement of the second frame member from the contact position to the separation position.

14. The developing device according to claim 13, wherein the first frame member includes an urging unit configured to urge the moving member, and wherein, when the developing device is in use in the image forming apparatus, the moving member is connected to the urging member.

15. The developing device according to claim 13, further comprising an urging unit connected to the moving member and configured to urge the moving member, wherein the urging unit is connected to the first frame member when the developing device is in use in the image forming apparatus.

16. The developing device according to claim 13, wherein, when the second frame member moves from the contact position to the separation position, the developer regulating member remains in contact with the developer bearing member.

17. An image forming apparatus configured to form an image on a recording medium, the image forming apparatus comprising:

an image bearing member for bearing an electrostatic latent image;

a developer bearing member configured to carry a developer for developing the electrostatic latent image;

a frame member configured to support the developer bearing member;

a charging member configured to charge the image bearing member;

a developer regulating member configured to regulate an amount of the developer to be carried by the developer bearing member;

a moving member configured to be rotatably disposed on the frame member and to support the developer regulating member, the moving member pressing the developer regulating member against the developer bearing member by a force received by contact of the charging member with the image bearing member; and a fixing unit configured to fix a developer image on the recording medium.

18. An image forming apparatus configured to form an image on a recording medium, the image forming apparatus comprising;

an image bearing member for bearing an electrostatic latent image;

a first frame member configured to support the image bearing member;

a developer bearing member configured to carry a developer for developing the electrostatic latent image;

a second frame member configured to support the developer bearing member and to be rotatably coupled with the first frame member, the second frame member being movable to a contact position to cause the developer bearing member to contact the image bearing member and a separation position to cause the developer bearing member to separate from the image bearing member;

a developer regulating member configured to regulate an amount of the developer to be carried by the developer bearing member;

a moving member configured to be rotatably disposed on the second frame member and to support the developer regulating member;

an urging unit configured to urge the moving member to press the developer regulating member against the developer bearing member, the urging unit being attached to the first frame member and the moving member and reducing a force for pressing the developer regulating member against the developer bearing member to be less than a force produced when the second frame member is in the contact position by a movement of the second frame member from the contact position to the separation position; and a contact-separation unit configured to cause the second frame member to move to the contact position and the separation position.

* * * * *